US006866374B2

(12) United States Patent
Taku

(10) Patent No.: US 6,866,374 B2
(45) Date of Patent: Mar. 15, 2005

(54) INK CARTRIDGE

(75) Inventor: Masakazu Taku, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/463,575

(22) Filed: Jun. 18, 2003

(65) Prior Publication Data

US 2003/0234831 A1 Dec. 25, 2003

(30) Foreign Application Priority Data

Jun. 21, 2002 (JP) ..... 2002-182161
Jun. 21, 2002 (JP) ..... 2002-182162

(51) Int. Cl.[7] ..... B41J 2/175; B41J 2/165
(52) U.S. Cl. ..... 347/86; 347/31; 347/33; 347/36
(58) Field of Search ..... 347/85–87, 31, 347/33, 36

(56) References Cited

U.S. PATENT DOCUMENTS

| | | | | |
|---|---|---|---|---|
| 6,123,409 | A | 9/2000 | Wolf | 347/33 |
| 6,168,259 | B1 | 1/2001 | Capurso | 347/36 |
| 6,176,565 | B1 | 1/2001 | Yanai et al. | 347/33 |
| 6,227,661 | B1 | 5/2001 | Hayakawa | 347/86 |
| 6,523,933 | B1 | 2/2003 | Hirano et al. | 347/36 |
| 6,612,683 | B2 | 9/2003 | Takahashi et al. | 347/30 |

FOREIGN PATENT DOCUMENTS

| | | |
|---|---|---|
| EP | 769380 | 4/1997 |
| EP | 786351 | 7/1997 |
| JP | 62-113554 | 5/1987 |
| JP | 6-237221 | 8/1994 |
| JP | 2000-86819 | 3/2000 |
| JP | 2001-146008 | 5/2001 |
| JP | 2002-86745 | 3/2002 |
| WO | 97/06010 | 2/1997 |

*Primary Examiner*—Shih-Wen Hsieh
(74) *Attorney, Agent, or Firm*—Fitzpatrick, Cella, Harper & Scinto

(57) ABSTRACT

There is provided an ink cartridge having at least one ink bag in which ink is housed, and a joint portion connected to the ink bag and coupled to a printer as required to supply ink. The ink cartridge has a first absorber that absorbs ink ejected to the outside of a sheet during printing, and a second absorber that directly receives, absorbs, and removes waste ink that may be transferred from a wiper during its operation of wiping off ink or the like remaining on an ejection opening formed surface of the printing head. The first and second absorbers are arranged at positions that sandwich the joint portion between themselves. Thus, the first and second absorbers can be effectively to collect adhering or leaking ink that may result from the installation and removal of the joint.

7 Claims, 23 Drawing Sheets

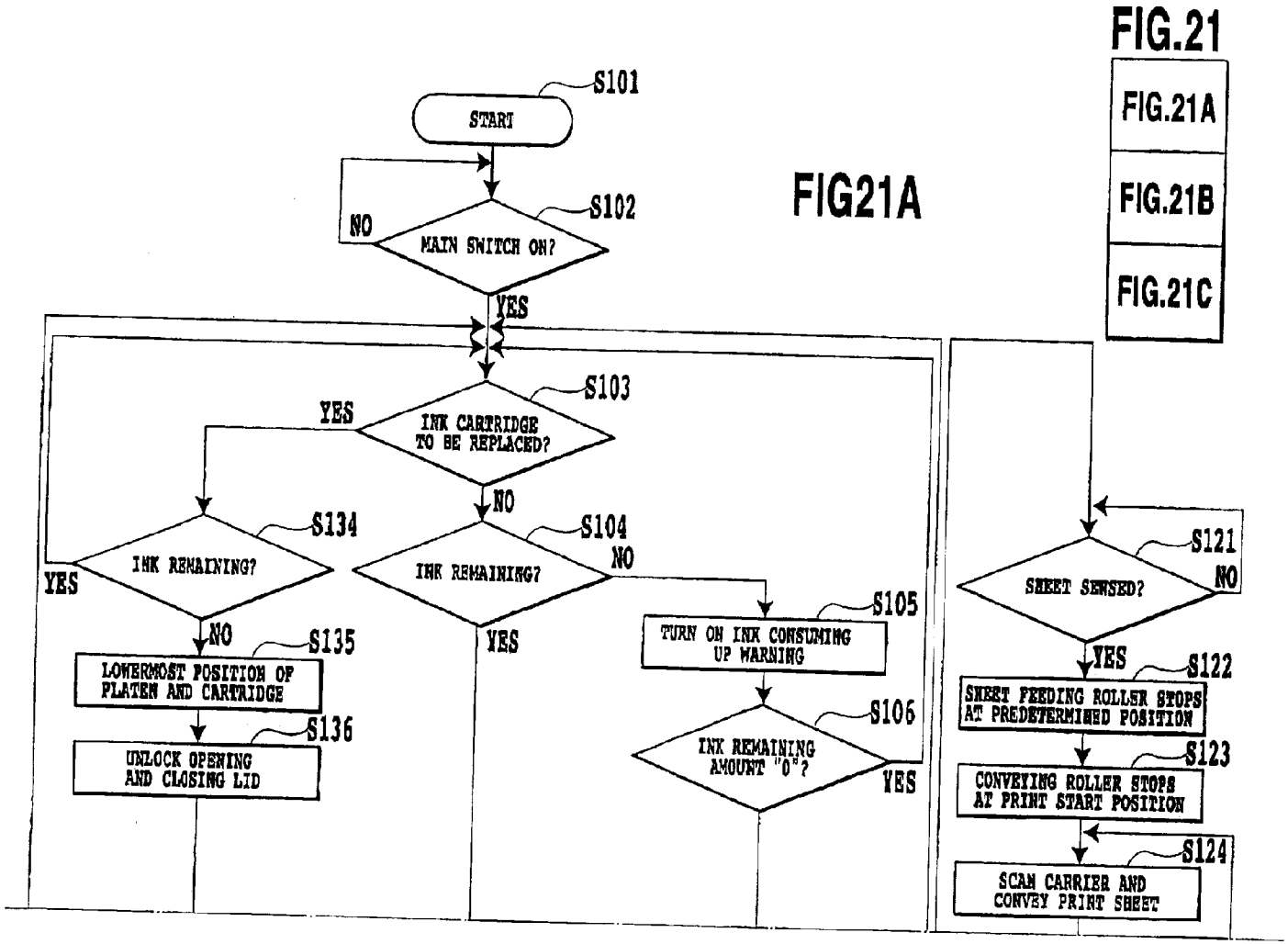
FIG.21
FIG.21A
FIG.21B
FIG.21C
FIG21A
S101
START
S102
MAIN SWITCH ON?
NO
YES
S103
INK CARTRIDGE TO BE REPLACED?
YES
NO
S104
INK REMAINING?
NO
YES
S105
TURN ON INK CONSUMING UP WARNING
S106
INK REMAINING AMOUNT "0"?
YES
S134
INK REMAINING?
YES
NO
S135
LOWERMOST POSITION OF PLATEN AND CARRIDGE
S136
UNLOCK OPENING AND CLOSING LID
S121
SHEET SENSED?
NO
YES
S122
SHEET FEEDING ROLLER STOPS AT PREDETERMINED POSITION
S123
CONVEYING ROLLER STOPS AT PRINT START POSITION
S124
SCAN CARRIER AND CONVEY PRINT SHEET

INK CARTRIDGE

This application claims priority from Japanese Patent Application Nos. 2002-182161 filed Jun. 21, 2002 and 2002-182162 filed Jun. 21, 2002, which are incorporated hereinto by reference.

BACKGROUND OF THE INVENTION

1. Field of the Invention

The present invention relates to a cartridge removably installed in an ink jet printer to supply ink when a printing head is used to carry out printing, and in particular, to a cartridge in which ink to be supplied is contained and ink not contributing to printing is collected.

2. Description of the Prior Art

In an ink jet printer, if powdered paper or ink adheres to an ejection opening surface in which ink ejection openings are formed, the ejection of ink from the ejection openings may become unstable to degrade printing quality. In particular, in recent years, to achieve full color printing at a high speed, efforts have been made to increase the length of the printing head. Thus, there is a tendency to sharply increase the number of ejection openings from which ink is simultaneously ejected, thus increasing ejection frequency. Such an increase in the length of the printing head increases the amount of ink ejected per unit time and thus the amount of mist (ink mist) generated when ink is ejected. This in turn further increases the amount of mist (ink) adhering to the ejection opening surface of the printing head. Further, to form a high-quality image by improving the accuracy with which ejected ink droplets land on a printing medium, efforts have been made to reduce the spacing between the ejection opening surface and the printing medium. In these circumstances, a larger amount of ink (mist) adheres to the surface of the printing head (ejection opening surface).

Thus, to remove these attachments, a mechanism is provided which uses a wiper blade consisting of an elastic material such as rubber to periodically wipe these attachments off from the ejection opening surface (this operation will be hereinafter referred to as "wiping"). However, in particular, as more ink adheres to the ejection opening surface of the printing head, the ink cannot be sufficiently removed simply by wiping the ejection opening surface using an ordinary wiper blade.

Accordingly, it is important to provide a mechanism that removes powdered paper or waste ink wiped off from the ejection opening surface by wiping and adhering to the wiper blade, i.e. a mechanism that cleans the wiping blade. This is because cleaning the wiper blade at proper times prevents attachments from the wiper blade from disadvantageously adhering to the ejection opening surface during the next wiping.

Various such cleaning mechanisms for wiper blades have been proposed. A typical one of these proposed mechanisms comprises an absorber that abuts against a wiper blade to receive attachments (For example Japanese Patent Application Laid-open No. 6-237221 (1994)). However, the cleaning ability of such an absorber is limited. If it is not a precondition that this absorber is replaced as required or the absorber is not adapted to be replaced using an appropriate timing, the received attachments may adhere to the wiper blade in union with a cleaning operation. Then, it is impossible to achieve the original object to wipe the ejection surface while cleaning the wiper blade to maintain it in a cleaned condition.

Japanese Patent Application Laid-open No. 62-113554 (1987) employs an arrangement in which a carriage on which a printing head is mounted is scanned to bring a wiping blade as a first removing member into sliding contact with an ejection opening surface to remove attachments from this surface. Then, an absorber as a second removing member comes into sliding contact with the wiping blade to remove attachments already transferred to this surface. Furthermore, an absorber as a third removing member comes into sliding contact with the absorber as the second removing member to remove attachments transferred to this surface. The absorber as the third removing member is integrated with an ink cartridge having an ink bag in which ink to be supplied to the printing head is housed as well as a waste ink tank. Thus, waste ink received by the absorber as the third removing member is guided to the waste ink tank. This arrangement suppresses the contamination of the third removing member and thus of the first and second removing members. Further, the third removing member is replaced together with the ink cartridge. This makes it possible to sufficiently deal with repeated removing operations, thus allowing them to be reliably performed over a long period.

Some of the recent ink jet printing apparatuses use recording media cut to a desired size to enable full-face layout printing without any margins as in the case with silver salt photographs. This is a technique of printing an image on a sheet without any margins by laying it out on software so that a print area exceeds the width of the sheet. However, ink is ejected to the outside of the ends of printing medium or the width of the sheet in this technique, the ink ejected to the outside of the width of the sheet may be deposited on a platen to contaminate subsequently supplied recording media. Thus, an absorber is arranged at an appropriate position on the platen to absorb the ink ejected to the outside of the width of the sheet. This enables full-face layout printing without contaminating any subsequently supplied printing media.

However, the absorbing performance of such an absorber is limited. Consequently, if it is not a precondition that this absorber is replaced with a new one or the absorber is not adapted to be replaced using an appropriate timing, an ink that has failed to be absorbed may contaminate subsequently supplied printing media. In other cases, such ink may overflow in the apparatus to foul it.

Thus, International Publication WO 97/06010 discloses an arrangement comprising a cartridge in which objects to be printed (printing media) are housed and which is provided with a waste ink collecting section in which the above ink is reserved. Further, Japanese Patent Application Laid-open No. 2000-086819 discloses an arrangement comprising a platen on which a slit and using a cartridge in which printing media are housed and which is provided with an absorber. When this cartridge is installed in a printer main body, the absorber is set at a position corresponding to the slit. Thus, ink ejected to the outside of the ends of printing media is received by the absorber via the slit. In either of these applications, the waste ink collecting section or the absorber is replaced when the cartridge is replaced.

As described above, some conventional cartridges in which consumables (ink or printing media) of an ink jet printer are housed are provided with an absorber that receives waste ink resulting from wiping or ejected to the outside of the ends of printing media during full-face layout printing. Thus, when the cartridge is replaced, the absorber is also replaced. This prevents disadvantages caused by waste ink. However, ink which does not contribute to printing in an ink jet printer is not limited to waste ink resulting from wiping or ejected to the outside of the ends of printing media during full-face layout printing.

For example, for the purpose of reducing the size of a serial ink jet printer, or the like, Japanese Patent Application Laid-open Nos. 2000-086819, described above, and 2001-146008 employs a method (hereinafter referred to as an "intermittent supply method") in which a carriage on which a printing head is mounted is provided with a reserving section reserving a predetermined amount of ink, and a supply system is provided which intermittently supplies ink from an ink supply source to the reserving section at appropriate timings. During main scanning for printing, the ink supply system between the reserving section and the ink supply source is spatially disconnected to achieve fluid isolation between the reserving section and the ink supply source.

With this arrangement, since fluid communication is relatively frequently established and interrupted, ink supply joints of the reserving section and ink supply source are correspondingly attached and detached. Ink may adhere to these joints or may leak from them. Also, due to an unexpected contingency which may be caused by an environmental variation, a placing condition of a printer (for a portable printer, in case of bringing it) or the like, an ink seepage and an ink leakage from the ink supply joint of the ink supply source may occur. Further, it should be noted that a mist created by a printing operation may by accumulated in the vicinity of the ink supply joint of the ink supply source to form an ink drop. Alternatively, a case where the environmental variation induces a condensation around the ink supply joint of the ink supply source may be envisioned. Such adhered or leaked ink is an ink which does not contribute to printing (such non-contributable ink, including liquid such as the above-mentioned condensation, may also be referred to as an non-contributable liquid to printing). It is highly desired to adequately collect the non-contributable ink in order to avoid a soilure of an interior of a device, damage to an interior mechanism, an adhesion of ink or the like to an operator's hand and clothes, and an occurrence of color mixture of inks at the ink supply joint of the ink supply source (there may be a risk caused by the color mixture of inks at the ink supply joint to cause a color mixture of inks into the reserving section and to introduce an influence caused by the color mixture of inks into an interior of the ink supply source).

SUMMARY OF THE INVENTION

It is an object of the present invention to provide a cartridge for ink jet printer having an appropriate construction adapted for an effective use of an absorber (receiving member) for receiving waste ink which may be produced by an attachment and detachment of the ink supply joint of a reserving section side and an ink supply source side or alternatively for receiving adhered or leaked ink caused in such a manner as envisioned above, and an absorber (receiving body) for receiving waste ink ejected to the outside of a print medium during full-face layout printing.

In an aspect of the present invention, there is provided a cartridge that can be installed in an ink jet printer for performing printing on a printing medium by using a printing head for ejecting ink, the cartridge comprising a supply joint portion connected to the printing head as required and an ink housing portion in which ink to be supplied is accommodated, the cartridge comprising:

a first receiving member that receives ink ejected by the printing head to the outside of the printing medium; and a second receiving member that contacts with a wiper provided in the ink jet printer that wipes off ink remaining on an ejection opening formed surface of the printing head to receive ink resulting from the wiping operation performed by the wiper, and wherein the first and second receiving members are arranged so as to sandwich the supply joint portion between themselves.

The above and other objects, effects, features and advantages of the present invention will become more apparent from the following description of embodiments thereof taken in conjunction with the accompanying drawings.

BRIEF DESCRIPTION OF THE DRAWINGS

FIG. 17 is a sectional view taken along the carrier scanning direction and showing the print mechanism to illustrate the installation of the ink cartridge and the like;

FIG. 20 is a block diagram illustrating an embodiment of a control system applicable to the printer according to the first embodiment of the present invention or the like.

DETAILED DESCRIPTION OF PREFERRED EMBODIMENTS

The present invention will be described below in detail with reference to the drawings.

Incidentally, in the present specification, the wording "printing" or "recording" means not only a condition of forming significant information such as characters and drawings, but also a condition of forming images, designs, patterns and the like on printing medium widely or a condition of processing the printing media, regardless of significance or unmeaning or of being actualized in such manner that a man can be perceptive through visual perception.

Further, the wording "printing medium" means not only paper used in a conventional printing apparatus but also everything capable of accepting inks, such as fabrics, plastic films, metal plates, glasses, ceramics, wood and leathers, and in the following, will be also represented by a "sheet" or simply by "paper".

Still further, the wording "ink" (also referred to as "liquid" in some occasions) should be interpreted in a broad sense as well as a definition of the above "printing" and thus the ink, by being applied on the printing media, shall mean a liquid to be used for forming images, designs, patterns and the like, processing the printing medium or processing inks (for example, coagulation or encapsulation of coloring materials in the inks to be applied to the printing media).

Meantime, the present invention may be applied to a printing head in which a thermal energy generated by an electrothermal transducer is utilized to cause a film boiling to liquid in order to form bubbles, a printing head in which an electromechanical transducer is employed to eject liquid, a printing head in which a static electricity or air current is utilized to form and eject a liquid droplet and the others which are proposed in the art of an inkjet printing technology. Specifically, the printing head in which the electrothermal transducer is utilized is advantageously employed to achieve a compact structure.

(1) First Embodiment

A construction of a first embodiment of the present invention will be described below with reference to the attached figures.

(Construction of the Ink Cartridge)

Figure 1A:
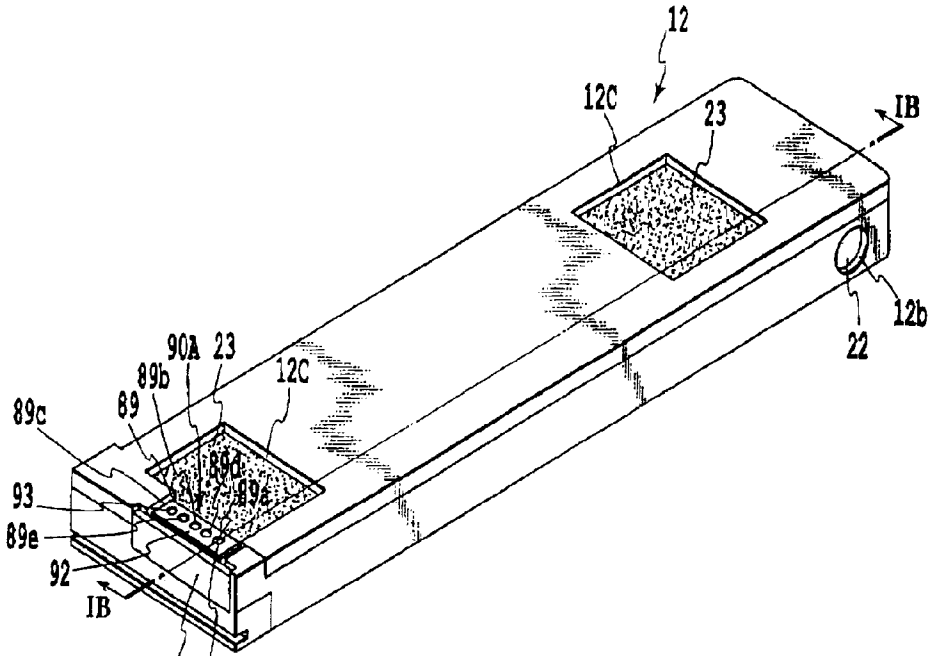
FIGS. 1A and 1B are a perspective view showing a broad overview of an ink cartridge and a cross sectional view along with a IB—IB line of FIG. 1A, respectively, showing an ink cartridge to which the present invention is applied.
Figure 1B:
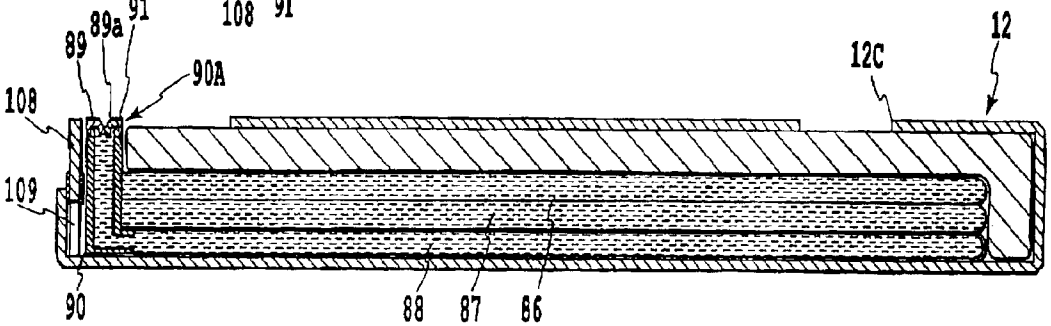
Figure 2:
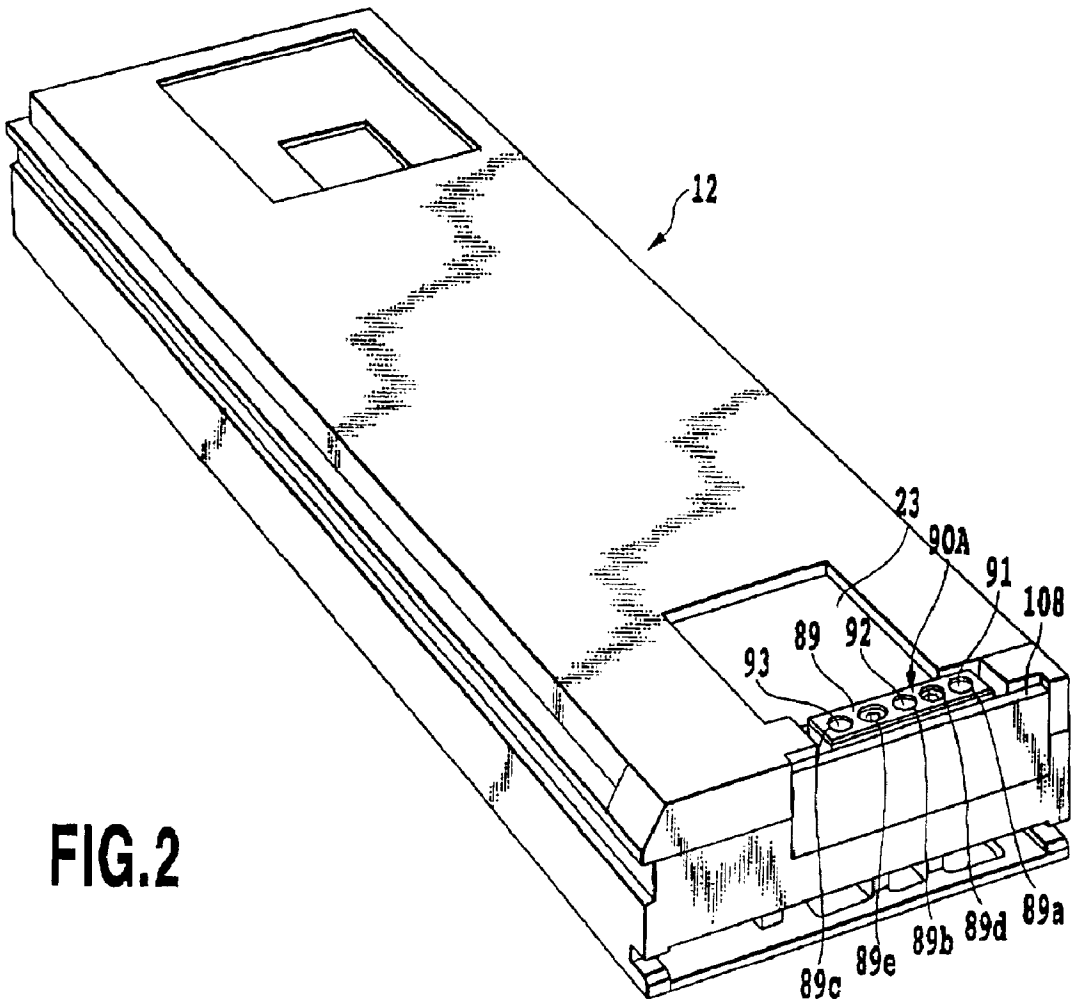
FIG. 2 is a perspective view showing the ink cartridge of FIG. 1A viewing from a back face.

FIG. 1A is a perspective view showing a broad overview of an ink cartridge 12, FIG. 1B is a cross sectional view along with a line IB—IB of FIG. 1A, and FIG. 2 is a perspective view showing the ink cartridge of FIG. 1A viewing from a back face, respectively.

The ink cartridge 12, as shown in FIG. 1B, receives ink bags 86, 87, 88 therein in a buildup manner. On an upper portion of the built-up bags, not described into detail here, a waste ink absorber 23 for receiving and absorbing ink ejected to the outside of the printing medium during full breed printing or full-face layout printing is placed facing outward through openings 12*c* disposed on the ink cartridge 12. The openings 12*c* is illustrated in such a manner to be provided partially within a predetermined area onto which excessive ink is ejected. It is needless to say that the opening can be formed almost throughout the entire area. The ink bags 86, 87, 88 each is connected to a joint case 90 forming a path for feeding ink into the ink supply part and includes an ink joint portion 90A placed in the vicinity of one end of the ink cartridge 12. The ink joint portion 90A is designed to receive an ink supply needle of the printing head. The waste ink absorber 23 described above and the ink joint portion 90A are placed adjacent to each other. The ink joint portion 90A is provided with joint rubbers 91, 92, 93 for closing corresponding path at an end opposite the connecting part between the ink joint portion and the joint case 90. The joint rubbers are press fitted against the joint case 90 by a joint rubber pressure plate 89. Through the ink joint portion 90A, an outer end of one side of the ink cartridge 12 opposite to the waste ink absorber 23, details will follow, has a wiper ink absorbing pad 108, held by a pad holder 109, for wiping waste ink adhered to the wiper blade used for cleaning an ink ejection surface of the printing head.

The wiper ink absorbing pad 108, the ink joint portion 90A and the waste ink absorber 23 are lined up in this order from one end of the ink cartridge 12.

As shown in FIGS. 1A and 2, the wiper ink absorbing pad 108, ink joint portion 90A and waste ink absorber 23 are placed facing to one surface of the ink cartridge 12. The surface will be an upper surface when the ink cartridge 12 is installed on the printer to form a preferable printing attitude.

In the ink cartridge employing the above described construction, if an intermittent supplying system is adopted, the ink supply needle of the printing head and the ink joint portion of the ink cartridge will often be attached to or removed from each other. Therefore, if ink adhesion to the joint portion or ink leakage from the joint portion occur, ink can be collected from the ink joint portion by means of the wiper ink absorbing pad or the waste ink absorber, or a combination thereof because the wiper ink absorbing pad for receiving the waste ink produced by wiping and the waste ink absorber for receiving waste ink ejected to the outside of a printing medium during full-face layout printing are positioned on both sides of the ink joint portion.

In the case where an ink seepage and an ink leakage from the ink supply joint portion 90A of the ink cartridge 12 as the ink supplying source occur due to the unexpected contingency, which may be caused by an environmental variation, a placing condition of a printer (for a portable printer, in case of bringing it) and the like, it the cartridge for ink jet printer faces to an printing area, where the mist created by the printing operation accumulates around the ink supply joint portion 90A of the ink cartridge 12 as the ink supply source to form an ink drop, and further where the environmental variation induces a condensation around the ink supply joint 90A of the ink supply source, ink or liquid can be collected from the ink joint portion 90A in such a manner described above.

The wiper ink absorbing pad 108 and the waste ink absorber 23 for absorbing ink ejected to the outside of a printing medium during full bleed printing which are placed across the ink joint portion 90A are in the state of being soaked with ink itself being a transfer ink from the wiper and/or ink ejected to the outside of a printing medium. The absorber, once soaked with ink or the like, comes to have better ink absorbing permeability compared to the one in completely dry condition. That is, such a soaked absorber is in easy-to-collect condition for the ink transferred from the ink joint portion 90A, resulting in being a more preferable condition to achieve ink collection. Therefore, the construction of the present invention as stated above, i.e. using other ink absorbing member as the ink collection absorber, has better collection ability for ink and more contributes to a simple construction around the ink joint portion than a construction having an ink collecting absorber of a sole use for the ink joint portion 90A.

The above-stated construction make it possible to avoid soilure of an interior of a device, damage to an interior system, adhesion of ink or the like to an operator's hand or clothes and a mixture of colors caused at the ink supply joint of the ink supply source (such mixture of colors at the ink supply joint may cause a mixture of colors of the supply ink into the reserving section and further affect an interior of the ink supply source).

Namely, an application of the above construction to the ink cartridge according to the present invention enables an effective use of the absorber for receiving waste ink produced by wiping and the absorber for receiving waste ink ejected to the outside of the printing medium during full-face layout printing.

Ink bags 86, 87, 88 housed within the ink cartridge 12 each is injected with color inks such as yellow, cyan and magenta. It is a matter of course that the number of ink bags corresponding to the number of the kinds of colors, density or the like should be prepared.

According to the present embodiment, joint rubbers 91, 92, 93 are provided color by color. However, it is also possible to prepare a uniform member having rubber seal portions for each color to be sealed.

Here, joint rubbers 91, 92, 93 each may be formed from elastomer or chlorinated butyl rubber or the like, and may, for example, have a duckbill-shape and provided with a slit-like cut at a center of each joint rubber so as to penetrate it. In order to enable the joint rubbers for a plurality of reliable removals, other construction may be applicable.

The pressure plate 89 is provided with holes 89*c*, 89*b*, 89*a* for allowing the ink supply needle 94, 95, 96 of the printing head to pass through the pressure plate. The printing head, as will be described later, is provided with positioning pins 97, 98, and the pressure plate 89 is also provided with holes 89*d*, 89*e* each of which fits corresponding positioning pins 97, 98. The hole 89*e* is a hole having a length for allowing compensation of a center pitch error.

The waste ink absorber 23 may also be formed from felt or fibrous sheet, and further maybe formed from any material such like high-molecular type absorber which can absorb more amount of waste ink than its original volume, the volume before absorbing the waste ink. When using the latter, more its volume increases as going on the absorption of waste ink, smaller the ink amount at the time and therefore further smaller the size of the ink bag, so that an expansion of the high-molecular type absorber induced by the absorption of waste ink will not cause the ink leakage due to an application of pressure to the ink bag by the expanded absorber.

As a suitable example according to the present embodiment, the wiper ink absorbing pad 108 and the waste ink absorber 23 each is described as a construction using a so-called absorber having an absorbing ability. However, the suitable construction is not limited to the one explained above. The equal function can be produced by, for example, a construction providing a plurality of narrow grooves to generate a capillary force against hard material (ex. It may be a housing of the ink cartridge 12 itself.), thereby trapping or collecting the ink or the like. In the case, it is more preferable to construct such that an absorber is placed on, for example, each end of the capillary path of the grooves to collect and hold the ink.

The ink cartridge 12 is provided with an opening 12*b* for receiving a drain pipe arranged on the printer in order to collect waste ink discharged from the printer. A backflow prevention membrane 22 is placed at the opening 12*b* so that no backflow of waste ink from the drain pipe happens. This backflow prevention membrane 22, is not always necessary to be placed at the opening 12*b* if a construction of a waste ink collection system and the opening 12*b* do not require. The backflow prevention membrane is preferred to be placed when a better safety is desired. In order to enable the collection of such waste ink, the waste ink absorber 23, as shown in FIG. 1B, is placed in such a manner to form generally L-shape within the ink cartridge 12. The waste ink absorber 23 is designed in such a manner that neither of an ink collected during full bleed print nor a waste ink collected from the drain pipe of the printer during a collecting operation stool stays at the position the ink flows in, and is uniformly dispersed within the entire waste ink absorber. Therefore, the waste ink will not flow out of a specific area.

(Printer Construction)

A printer to which the above-described ink cartridge is installed is described hereinafter.

Figure 3:
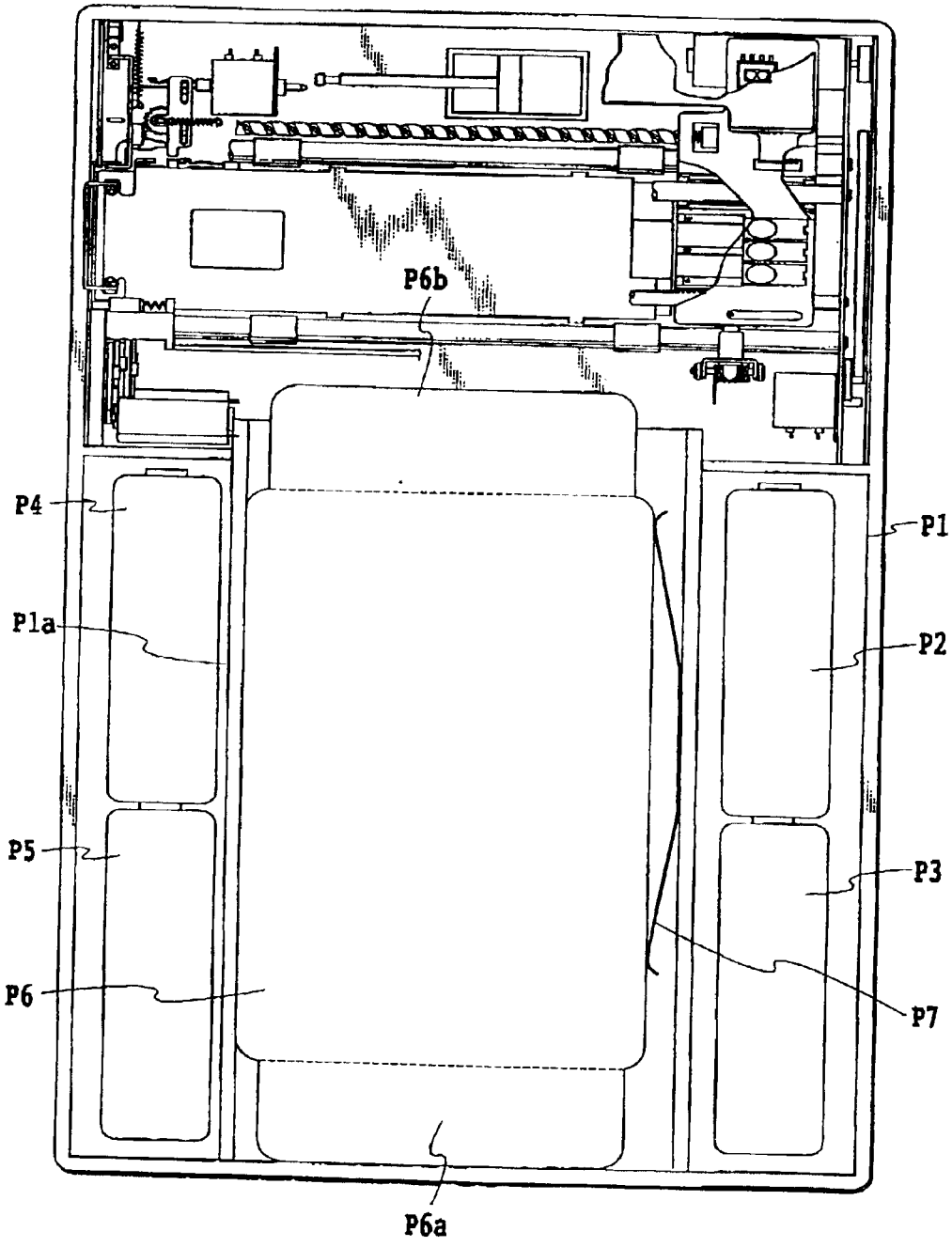
FIG. 3 is a plan view showing an entire configuration of a printer according to a first embodiment of the present invention.
Figure 4:
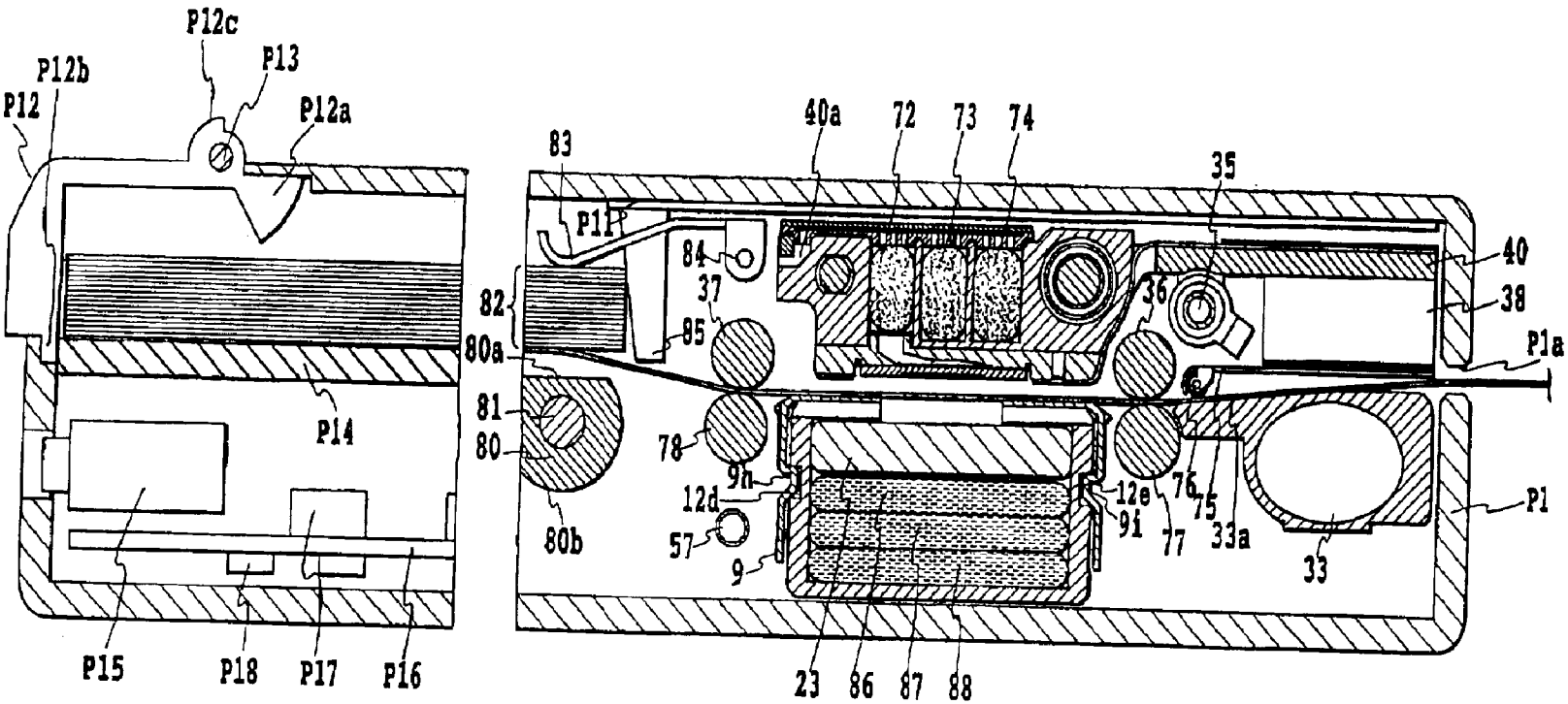
FIG. 4 is a side sectional view taken along the direction in which a printing medium is conveyed, the view showing a print mechanism of the printer according to the first embodiment.

FIG. 3 is a plan view showing the entire configuration of the printer with an upper cover of an outer case removed. FIG. 4 is a side sectional view taken along a sub-scanning direction (a direction in which print media are conveyed).

In FIG. 3, reference numeral P1 denotes a printer main body constituting an outer case. Reference numerals P2 to P5 denote batteries used as a power source for the printer and laid out in series. Reference numeral P6 denotes a print sheet having tabs P6*a* and P6*b* formed at a leading and trailing ends, respectively, so as to serve as margins. These tabs can be cut off at perforations shown by broken lines after a printing operation has been completed to provide a photograph without any margins. Reference numeral P7 denotes a spring that biases and urges the print sheet P6 against a print reference surface P1*a*. The spring serves to prevent the print sheet P6 from being misaligned or fed obliquely.

In FIG. 4, reference numeral P14 denotes a pedestal on which sheets 82 as the print sheets P6 are stacked. The pedestal P14 is fixed to the printer main body P1. Further, reference numeral P15 denotes a connector conforming to a USB standard or the like and which is used to connect the printer to external equipment. The connector is attached to a main print plate P16. Reference numerals P17 and P18 illustratively denote electric parts mounted on the main print plate P16. A main IC (not shown) is also mounted on this main print plate to control operations of the printer.

(Opening and Closing Lid for Installing Ink Cartridge)

Figure 5:
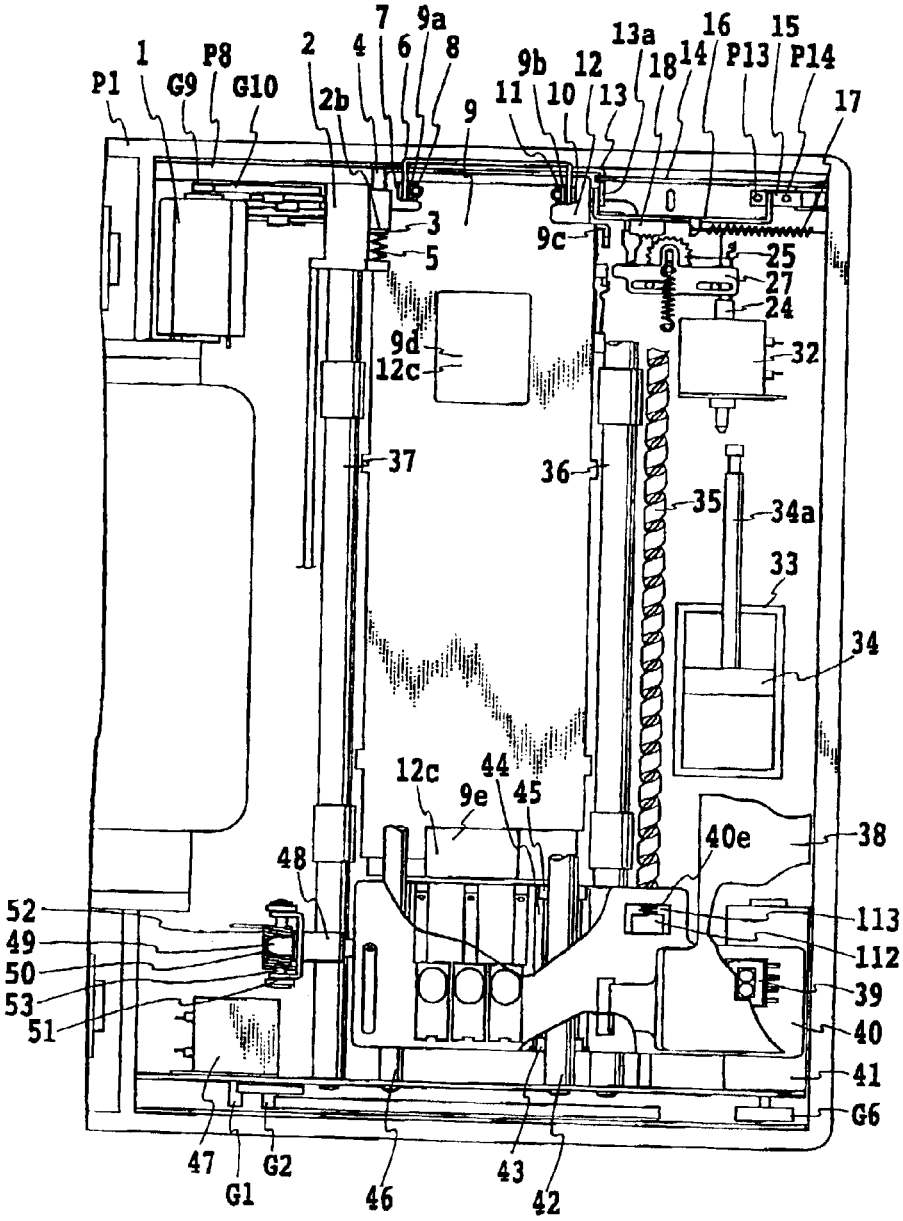
FIG. 5 is an enlarged plan view of the print mechanism in the printer in FIG. 3.
Figure 6:
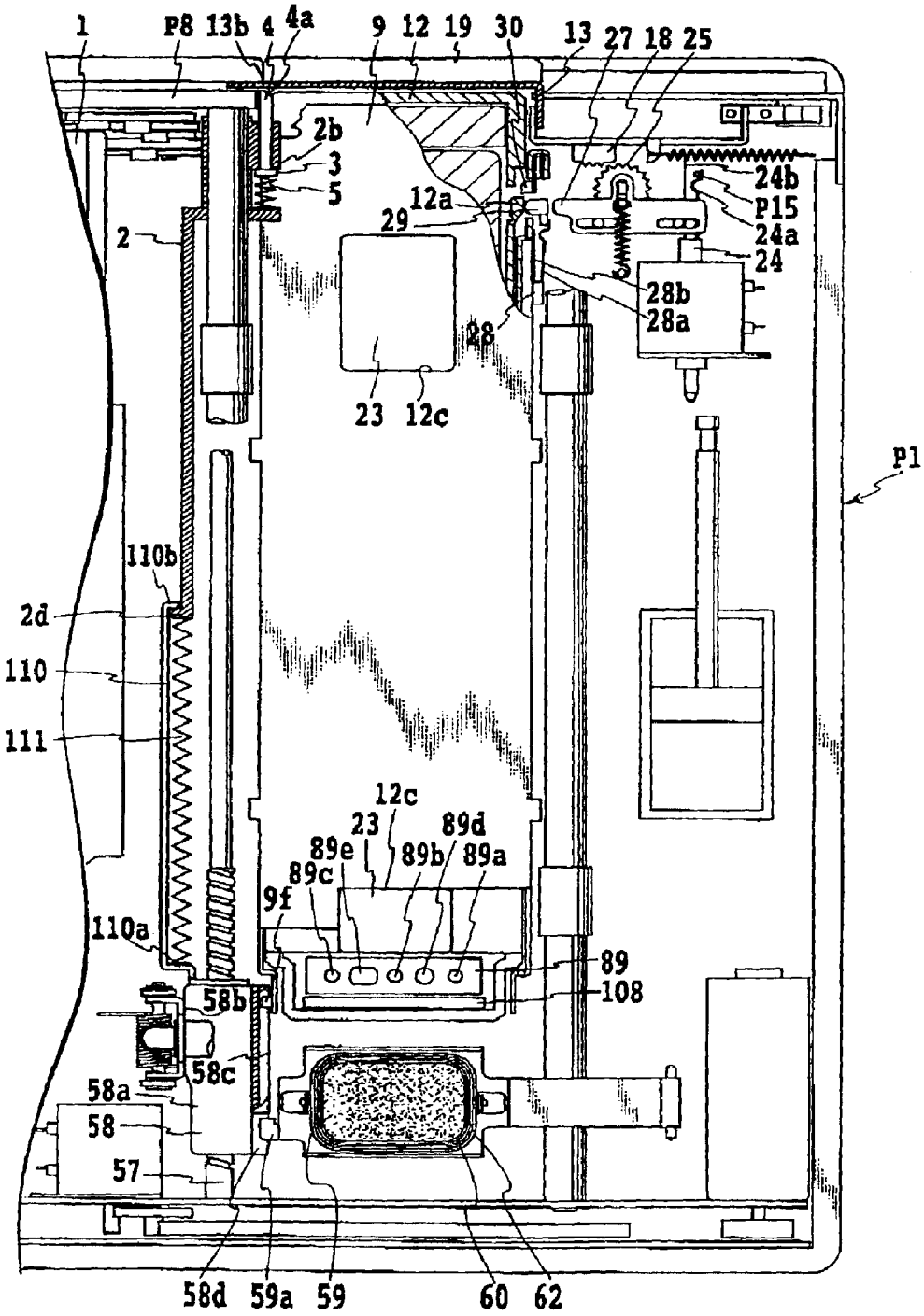
FIG. 6 is a plan view illustrating a mounting portion of the ink cartridge in the printer according to the first embodiment with some of the constituent members in FIG. 5 removed.
Figure 7:
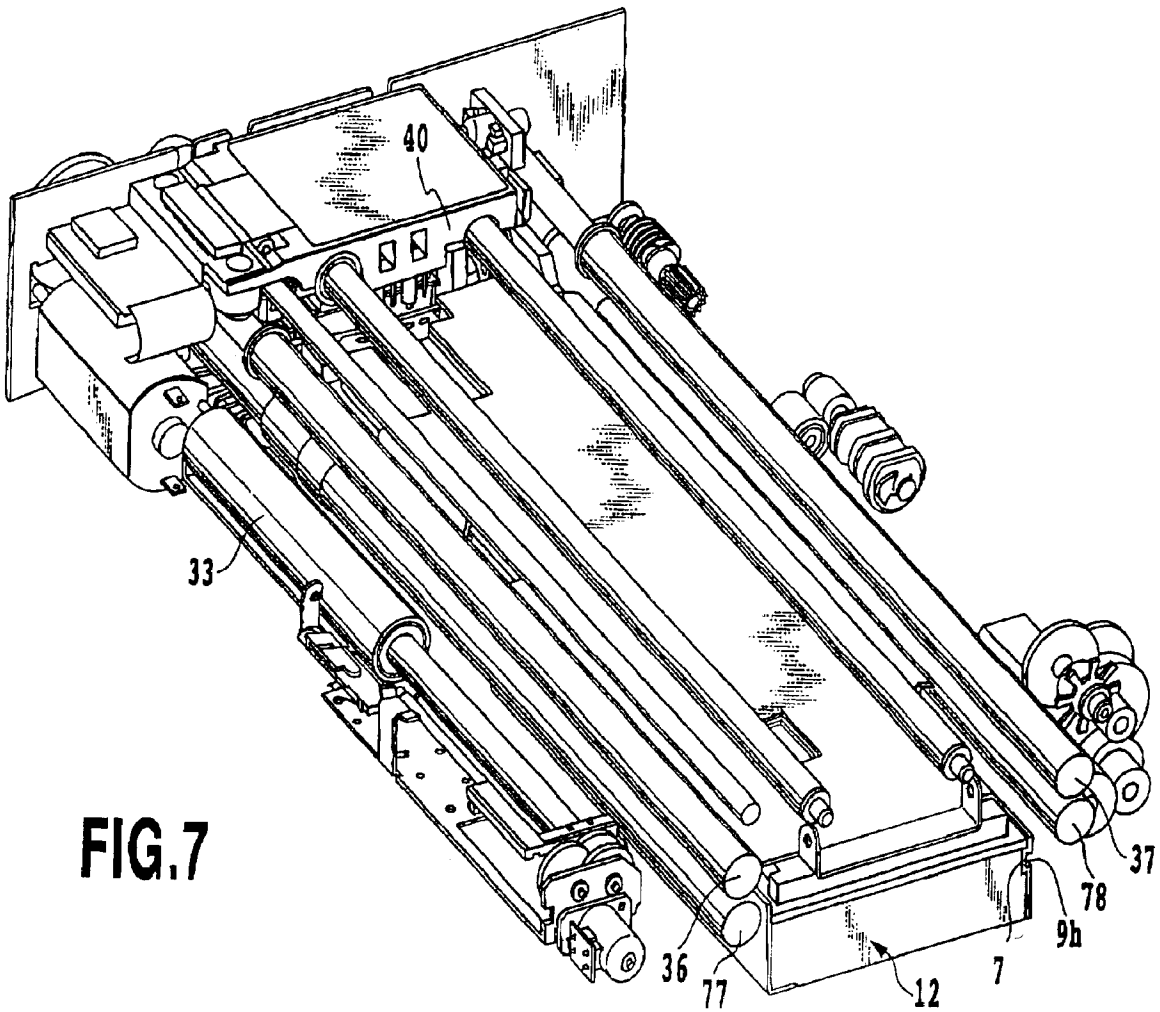
FIG. 7 is a perspective view of the print mechanism in FIG. 5.

FIG. 5 is an enlarged plan view showing the configuration in FIG. 3, notably a print mechanism. FIG. 6 is a plan view illustrating the printer with a carrier mechanism in FIG. 5 removed. FIG. 7 is a perspective view of the print mechanism.

In the present example, an ink cartridge accommodating ink as a print agent is slidably installed in the print mechanism in the same direction along the scan direction of a carrier 40. In the present configuration, an opening and closing lid 19 in FIG. 6 is fully opened to open an installation port. Then, the ink cartridge 12 is slidably installed through the installation port of the lid side.

In FIG. 5, reference numeral 2 denotes a lock slider slidably fitted over a pinch roller 37 that presses the print sheet P6 against a conveying roller 78 shown in FIG. 4 to exert a conveying force when the sheet is conveyed. The lock slider 2 has a lock pin 4 used to prevent a lid guide plate 13 from sliding inadvertently, the lid guide plate 13 being integrated with the opening and closing lid 19, which is opened and closed when the ink cartridge 12 is replaced. The lock slide 2 slidably moves to cause the lock pin 4 to slip out of the lid guide plate 13 to allow the opening and closing lid 19 to be opened and closed. Further, the lock pin 4 is programmed to return to the locked position when the opening and closing lid 19 is fully opened. When the opening and closing lid 19 is closed again, the lid guide plate 13 pushes a slope portion 4*a* (shown in FIG. 6) of the lock pin 4 to slidably move the lock pin. When the opening and closing lid 19 is fully closed, the lock pin 4 is fitted into a hole portion 13*b* (shown in FIG. 6) in the lid guide plate 13 to lock the opening and closing lid 19. A contact 3 is integrated with the lock pin 4 and also used to prevent the lock pin 4 from slipping out. The contact 3 is always urged toward a terminal portion 2*b* (see FIGS. 6 and 8) of the lock slider 2 by a spring 5. When the opening and closing lid 19 is closed, the lock pin 4 moves toward the spring 5 by the lid guide plate 13. Thus, the contact 3 is released from its contact state with the terminal portion 2*b*. Then, once the opening and closing lid 19 is fully closed and locked, the contact 3 is brought into contact with the terminal portion 2*b* again. The main IC, described later, allows it to be checked how the contact 3 is in contact with the terminal portion 2*b*.

Figure 8:
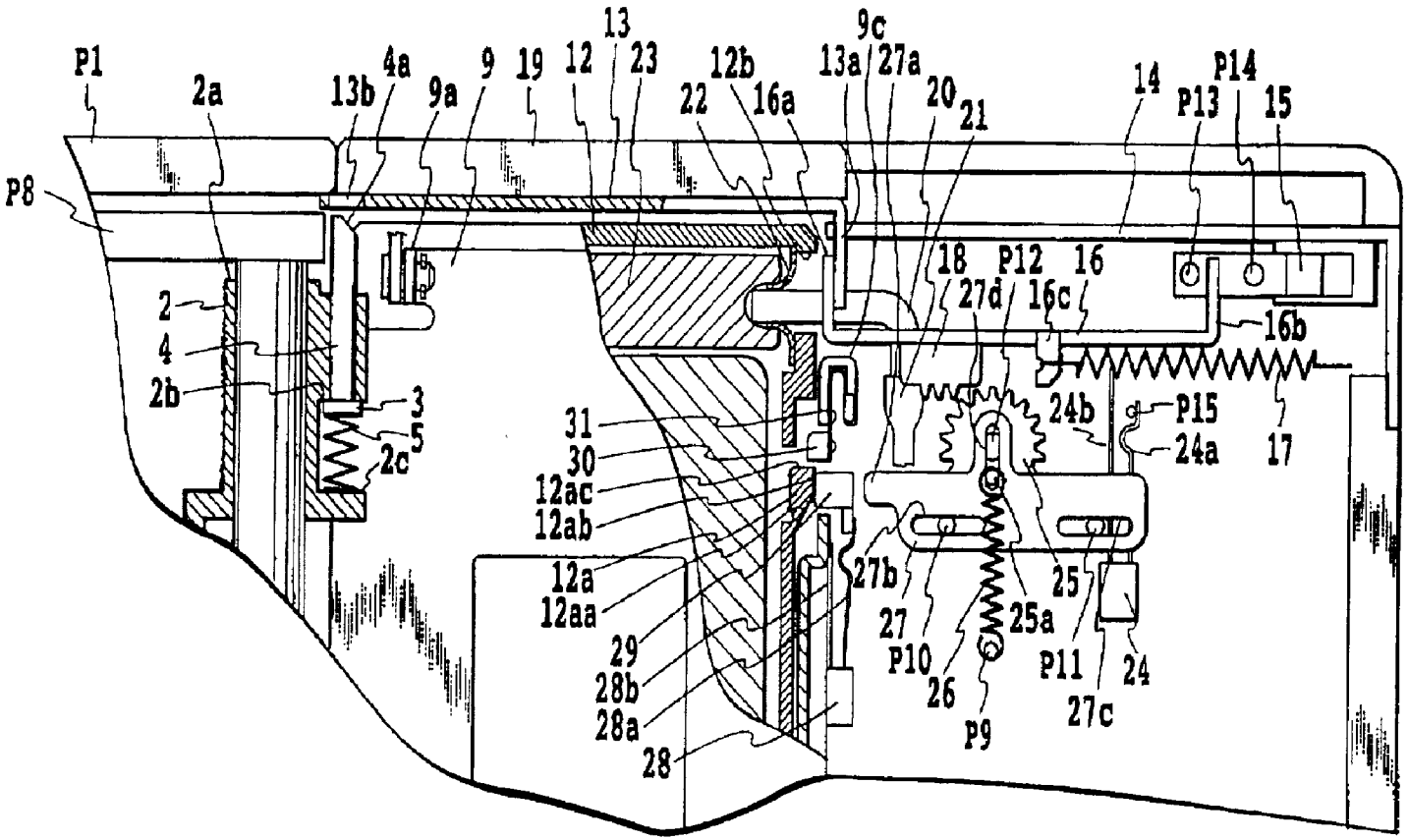
FIGS. 8 to 10 are partly enlarged plan views of the print mechanism, illustrating, in further detail, the operation of replacing the ink cartridge according to the first embodiment.

Reference numeral 14 denotes a decorative panel that serves as a screen when the opening and closing lid 19 is closed. As shown in FIG. 6 or 8, the decorative panel 14 guides an interlocking portion 13*a* of the lid guide plate 13. Reference numeral 15 denotes a click spring for locking the opening and closing lid as is fully open. The click spring 15 is fixed to the printer main body using a calking shafts P13 and P14. When the interlocking portion 13*a* of the lid guide plate 13 climbs over a convex portion the click spring 15, it is clicked and locked on the click spring 15 (see FIGS. 6 and 10).

In FIG. 6, reference numeral 110 denotes an interlocking member attached to a lift slider 58 using its flange portion 110*a*. The lift slider 58 may be moved along a lead on a shaft 57. The interlocking member 110 is provided with a hook portion 110*b* at its tip opposite to the flange portion 110*a* so that the a hook portion 2*d* of the lock slider can engage with the hook portion 110*b*. A compression spring 111 is disposed between the hook portion 2*d* and the flange portion 110*a*. The spring force of the compression spring 111 is set to be stronger than that of the spring 5, which presses the lock pin 4. Then, if the lock pin 4 is pushed when the opening and closing door 19 is closed, the spring 5 can be surely compressed to moved the lock pin 4 toward the spring 5 to release the contact 3 from the terminal portion 2*b*. Further, in the condition in FIG. 6, when the slider 58 moves away from the opening and closing lid 19, the lock slider 2 moves the distance as that the lift slider 58 has moved, in the same direction as that in which the lift slider has moved because the hook portion 110*b* is engaged with the hook portion 2*d*. Consequently, the opening and closing lid 19 is unlocked.

(Ink Cartridge Installing Mechanism and Sensing Mechanism)

Figure 9:
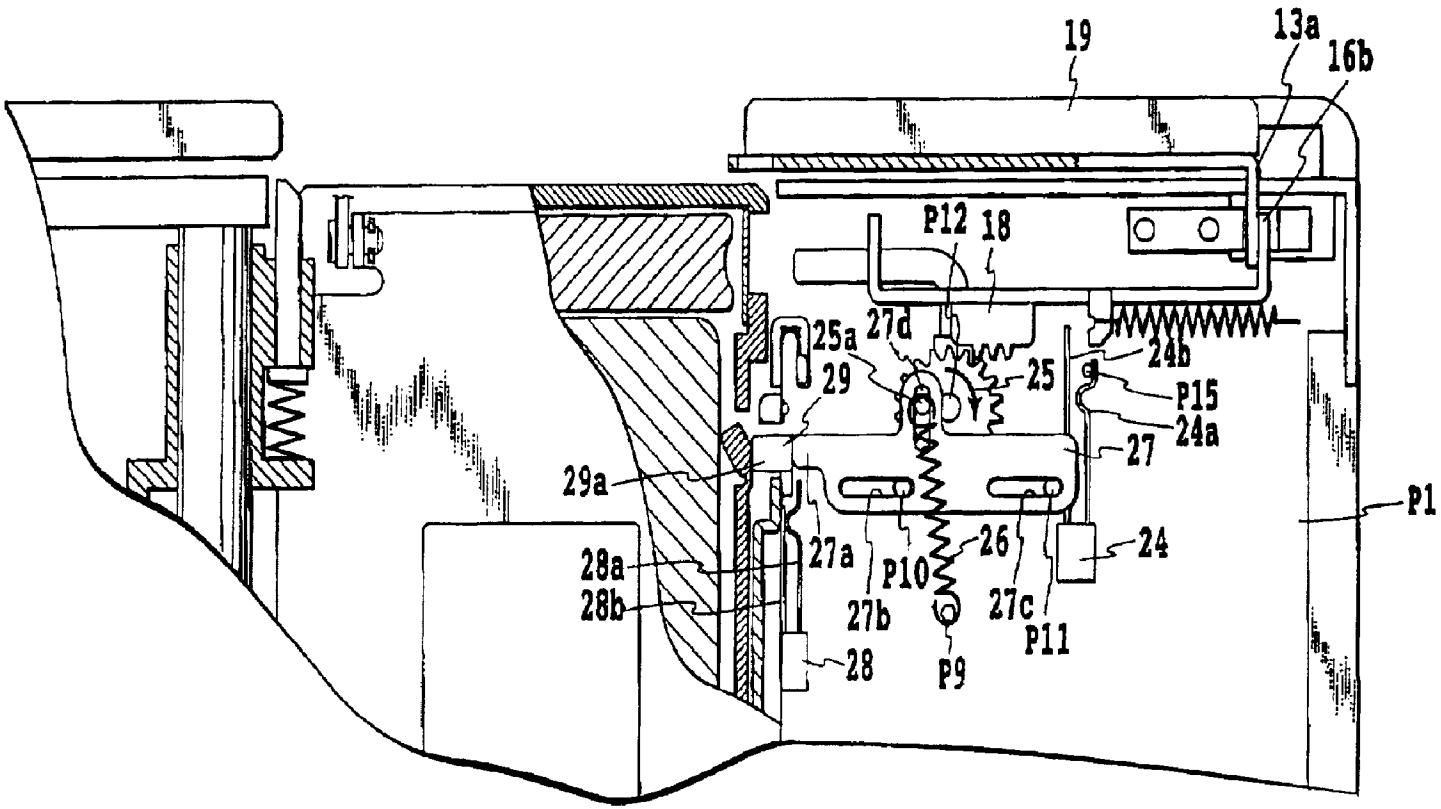
Figure 10:
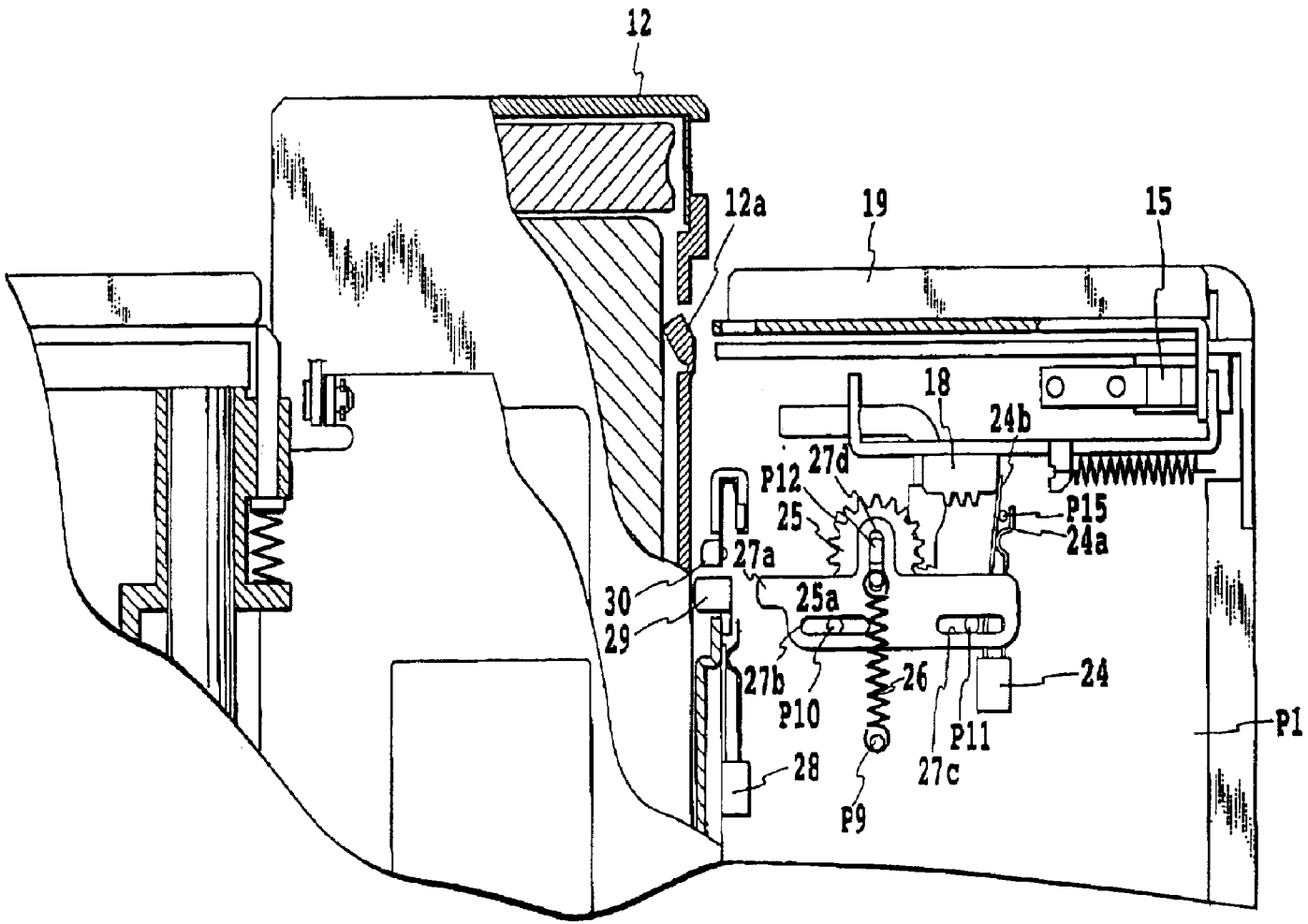

Reference numeral 24 shown in FIGS. 5, 6 and 8 to 10 denotes a full open switch sensing that the opening and closing lid 19 is fully open. A contact piece 24*a* of the full open switch 24 is positioned by the pin P15, fixed to the printer main body P1. On the other hand, when the opening and closing lid 19 is fully opened as shown in FIG. 10 to cause a rack gear 18 to push a movable contact piece 24*b*, thereby it comes into contact with the contact piece 24*a* to turn the switch 24 on.

A toggle gear 25 shown in FIGS. 5, 6 and 8 to 10 is rotatably supported by a rotating shaft P12, fixed to the printer main body P1. A drive pin 25*a* fitted into a slot 27*d* in an interlocking lever 27 is disposed at a position corresponding to a radius smaller than a pitch circle radius with which the rack gear 18 is engaged. A toggle spring 26 is connected to the drive pin 25*a*. The toggle spring 26 is extended between the drive pin 25*a* of the toggle gear 25 and a shaft P9 fixed to the printer main body P1. The toggle spring 26 is made to be stable in a manner as shown in FIG. 6. When the opening and closing lid is opened, the movement thereof cause the rack gear 18 to move, then the toggle gear 25 is rotated clockwise as shown in FIG. 9 by an arrow. When the opening and closing lid is closed, the movement thereof cause the rack gear 18 to move, then the toggle gear 25 is rotated counterclockwise (this motion is not shown) to disengage it from the rack gear 18, it returns to the condition in FIG. 8 owing to the force of the toggle spring 26.

As shown in FIG. 8, the interlocking lever 27 is slidable in the same direction as the opening and closing lid 19 because the slot 27*b*, 27*c* respectively engages the corresponding shaft P10 and P11 which are fixed to the printer body P1. Hence, when the toggle gear 25 is rotated clockwise by the rack gear 18, the interlocking lever 27 is moved leftward (so as to approach the installing section side of the ink cartridge 12) for the distance corresponding to the amount of eccentricity between the rotating shaft P12 of the toggle gear 25 and the drive pin 25*a*. Further, in a state immediately before the opening and closing lid 19 comes to be an entire opening state, i.e., immediately before the rack gear 18 comes out from toggle gear 25, as shown in FIG. 9, a position of the drive pin 25*a* is a moved position by 90 degree from the initial state, and if the opening and closing lid 19 is further moved to a full opening state, the toggle gear 25 is further rotated clockwise by about 10 degree resulting in that the drive pin 25*a* brings the interlocking lever 27 back to rightward against the previous moving direction, thereby preventing the interlocking lever 27 from moving forward. Moving relation between the rack gear 18 and the toggle gear 25 when the opening and closing lid 19 is closed has similar relation as above so that the unnecessary movement of the interlocking lever 27 is prevented.

As shown in FIG. 4, when the ink cartridge 12 is slidably installed in the printer main body P1, convex guide portions gh and gi of a platen 9 are fitted into concave guide portions 12*d* and 12*e*, respectively, of the ink cartridge 12 for positioning (only the guide portion 12*d* is shown in FIG. 2.). A projection 12*a* for indicating that an ink cartridge is unused condition is disposed at a lip portion of the concave guide portion 12*e* for positioning as shown in FIG. 6, the projection 12*a* being referred to as an "unuse-indicating projection" (not shown in the broad overview of an ink cartridge of FIG. 2). As shown in FIG. 8, a flat surface 12*ad* of a convex portion located at the top of the unuse-indicating projection 12*a* is flush with an outer surface of the ink cartridge 12 not to be protruded there from. This prevents a user from inadvertently folding the unuse-indicating projection 12*a* with his or her finger when installing the unused ink cartridge 12 in the printer.

Figure 12:
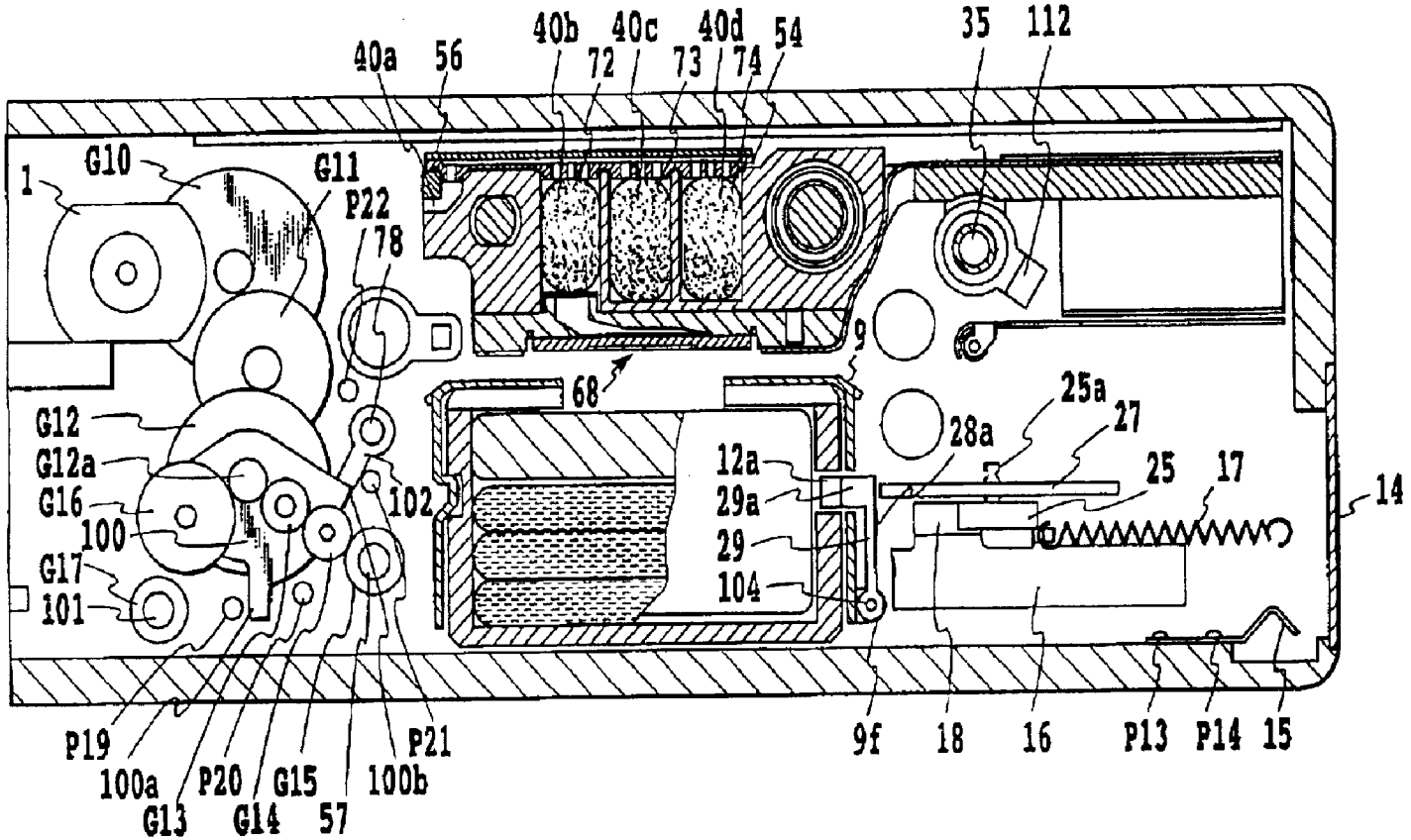
FIG. 12 is an enlarged sectional view taken along a carrier scanning direction and showing a part of the print mechanism to illustrate a configuration of an ink cartridge installing section, a transmission mechanism for lifting up the ink cartridge, and the like in the print mechanism.

Reference numeral 28 as shown in FIG. 6 denotes a presence or absence sensing switch of the ink cartridge 12 which is installed in the platen 9. Reference numeral 29 is a sensing lever 29 and, as shown in FIG. 12, is supported so as to rotate around the rotating shaft 104 by a shaft receiving portion 9*f* of the platen 9. Once an unused ink cartridge 12 is installed, since an unuse-indicating projection 12*a* is not yet bended, this unuse-indicating projection 12*a* pushes the convex portion 29*a* of the sensing lever 29 to cause a clockwise rotation as shown in FIG. 12 against a spring force of a movable contact piece 28*a* of the presence or absence sensing switch to separate the movable contact piece 28*a* from a fixed contact piece 28*b*, thereby turning off the presence or absence sensing switch. The main IC, described later, can recognize this condition as the one in which the ink cartridge 12 has been newly installed.

As shown in FIG. 9, as the lid 19, allowing the ink cartridge 12 to be removed, is opened, the interlocking lever 27 is moved to push and move the sensing lever 29 as described above, thereby the unuse-indicating projection 12*a* is folded and plastically deformed. The unuse-indicating projection can no longer be returned. Further, at this time, the presence or absence sensing switch 28 is turned on again, because a movable piece 28*a* thereof is in contact with a fixed piece 28*b*, as shown in FIG. 9. If the ink in the ink cartridge 12 is consumed up, the opening and closing lid 19 is fully opened. Even if the ink cartridge 12 is removed, the presence or absence sensing switch 28 remains on. Further, even if the ink cartridge 12 in which no ink is contained is removed and then installed again, the presence or absence sensing switch 28 is not turned off. Thus, in this case, ink remaining amount storage information (information indicating that ink has been consumed up) for the printer is not reset so that this ink cartridge can be distinguished from an unused one. Furthermore, naturally enough, if the opening and closing lid is fully opened as shown in FIG. 9 but the ink cartridge 12 with no ink is not removed, the presence or absence sensing switch 28 is not turned off. Accordingly, the main IC can detect that the ink cartridge 12 has not been replaced. This prevents the ink cartridge with its ink consumed up from being mistaken for an unused cartridge to inconveniently cause a blur during printing.

Reference numeral 30 shown in FIG. 6 or 8 denotes a stopper member that prevents the ink cartridge 12 from slipping out. As shown in FIG. 8, the stopper member 30 is attached to a generally U-shaped leaf spring 31 and is set on a generally U-shaped portion of the platen 9. As installation of an unused ink cartridge 12 proceeds in the installing section of the printer, the stopper member 30 is pushed by a slope portion 12*aa* of the unuse-indicating projection 12*a*. At the same time, the leaf spring 31 is flexed. When the installation of the cartridge 12 is completed, the reaction force of the leaf spring 31 returns the stopper member 30 to its original position. Then, in this state, even if an attempt is made to remove the ink cartridge 12, an end 12*ac* of the unuse-indicating projection 12*a* abuts against the stopper member 30. Accordingly, the installed ink cartridge 12 is prevented from being inadvertently removed or slipping out.

On the other hand, when only a little or no ink remains in the ink cartridge 12 and the latter is thus replaced, the opening and closing lid 19 is opened to cause the convex portion 27*a* of the interlocking lever 27 to push the sensing lever 29. Accordingly, as shown in FIG. 9, the convex portion 29*a* folds or cuts the unuse-indicating projection 12*a*. Consequently, the end 12*ac*, which has been abutted against the stopper member 29, moves away. Further, a surface 12*ab*, which has been abutted against the sensing lever 29, acts as a tapered face to engage with the stopper member 30 to flex the leaf spring 31. Therefore, even if the unuse-indicating projection 12*a* is insufficiently folded, no problem occurs when the ink cartridge 12 is removed. Furthermore, if the unuse-indicating projection 12*a* is cut when folded, nothing abuts against the stopper member 30. It should thus be appreciated that the ink cartridge 12 can be properly removed.

In the present embodiment, the ink cartridge 12 has a housing made of resin molding. However, the material for the housing may be metal. It is needless to say that an appropriate material may be used provided that the unuse-indicating projection 12*a* can be similarly folded. Further, instead of being integrated with a case, the ink cartridge 12 may be constructed by combining separate parts with each other.

(Coupling of the Platen and Ink Cartridge)

In FIG. 5, reference numeral 1 denotes a motor used to drive a sheet feeding roller. A mechanism described later switches a path through which the driving force of the motor 1 is transmitted, to drive a mechanism that lifts up the ink cartridge.

In FIG. 5, reference numeral 6 denotes a hinge plate fixed to the printer main body P1. As described later, the hinge plate 6 is a member used to lift up the platen 9 together with the ink cartridge 12. Pins 7 and 10 are projected from the hinge plate 6. The pins 7 and 10 are loosely fitted into parts 9*a* and 9*b*, respectively, of the platen 9 so as to act as pivots when the platen is lifted up. Reference numerals 8 and 11 denote locking washers that prevent the pins 7 and 10 from slipping out.

The platen 9 is a reference plate against which sheets are pressed to flatten their printing surfaces. In the present example, as described above, the opening and closing lid 19 is fully opened to form an installation port through which the ink cartridge 12 can be slidably installed. At this time, as shown in FIG. 5, convex guide portions 9*h* and 9*i* used as a positioning reference are fitted into concave guide portions 12*d* and 12*e*, respectively, of the ink cartridge 12 to establish an installed state. Consequently, when the pins 7 and 10 are used as the pivots to lift up the platen 9 in order to supply ink as described later, the ink cartridge 12 is lifted up integrally with the platen 9. Further, the platen 9 is formed with openings 9*d* and 9*e* so that ink ejected to the outside of a sheet can pass through the openings 9*d* and 9*e* when the entire surface of the sheet is printed (full bleed print). Further, the ink cartridge 12 is formed with openings 12*c* aligned with the openings 9*d* and 9*e*, respectively, in the platen 9 when it is completely installed. Accordingly, ink ejected to the outside of a sheet may pass through the openings to be received by a waste ink absorber in the ink cartridge 12.

On the other hand, as shown in FIG. 5 or 8, the printer main body P1 is provided with a drain guide plate 16 that is supported by the printer main body P1 so as to slidable in the same direction as that in which the lid guide plate 13 moves slidably. As shown in FIG. 8, a spring 17 is extended between a hook portion 16*c* of the drain guide plate 16 and the printer main body P1 to always urge the opening and closing lid 19 in a direction in which it is open. Further, an interlocking portion 16*a* or 16*b* abuts against the interlocking portion 13*a* of the lid guide plate 13. As described above, the rack gear 18 is fixed to the drain guide plate 16. Sliding movement of the drain guide plate 16 engages only a rack gear portion (in FIG. 8, only three teeth) with the toggle gear 25 to rotate the toggle gear 25 by a predetermined amount.

As shown in FIG. 8, the drain pipe 20 is generally L-shaped and is fixed to the drain guide plate 16. One end of the drain pipe 20 is connected to a cylinder pump 33 shown in FIG. 5 via a tube 21. When the ink cartridge 12 has been installed and the opening and closing lid 19 has been closed, as shown in FIG. 8, the other end of the drain pipe 20 is inserted into the waste ink absorber 23 in the ink cartridge 12. In this condition, waste ink can be discharged.

(Main Scanning Mechanism and Printing Head)

In FIG. 5, the reference numeral 35 denotes a lead screw which is a member for performing a reciprocate scan drive for a carrier 40 incorporating the printing head 68 therein in the orthogonal direction (main scanning direction) to a sheet feeding direction (sub scanning direction). The lead screw 35 is rotatably driven by a driving force conveyed from the driving motor 41 to a screw gear, not shown, press fitted into a shaft of the lead screw 35 through a pinion gear G6 press fitted into a motor shaft and idler gear, not shown. The lead screw 35 and the carrier 40 are connected each other through a lead piece 112, which is engaged in a hole portion 40*e* of the carrier 40 to be pressed in the scanning direction of the carrier 40 by a spring 113 and a portion thereof engages a groove of the lead screw 35, resulting in a reciprocate movement of the carrier 40 associating with the rotation of the lead screw 35. The lead piece 112 for the lead screw 35 in this embodiment is featured in that the carrier 40 is controlled of its attitude by the main shaft 42 and the guide shaft 46 to perform a reciprocate movement, so that the lead piece 35 is essential for the present embodiment in connecting it with the lead screw 35 as the third shaft.

Figure 13:
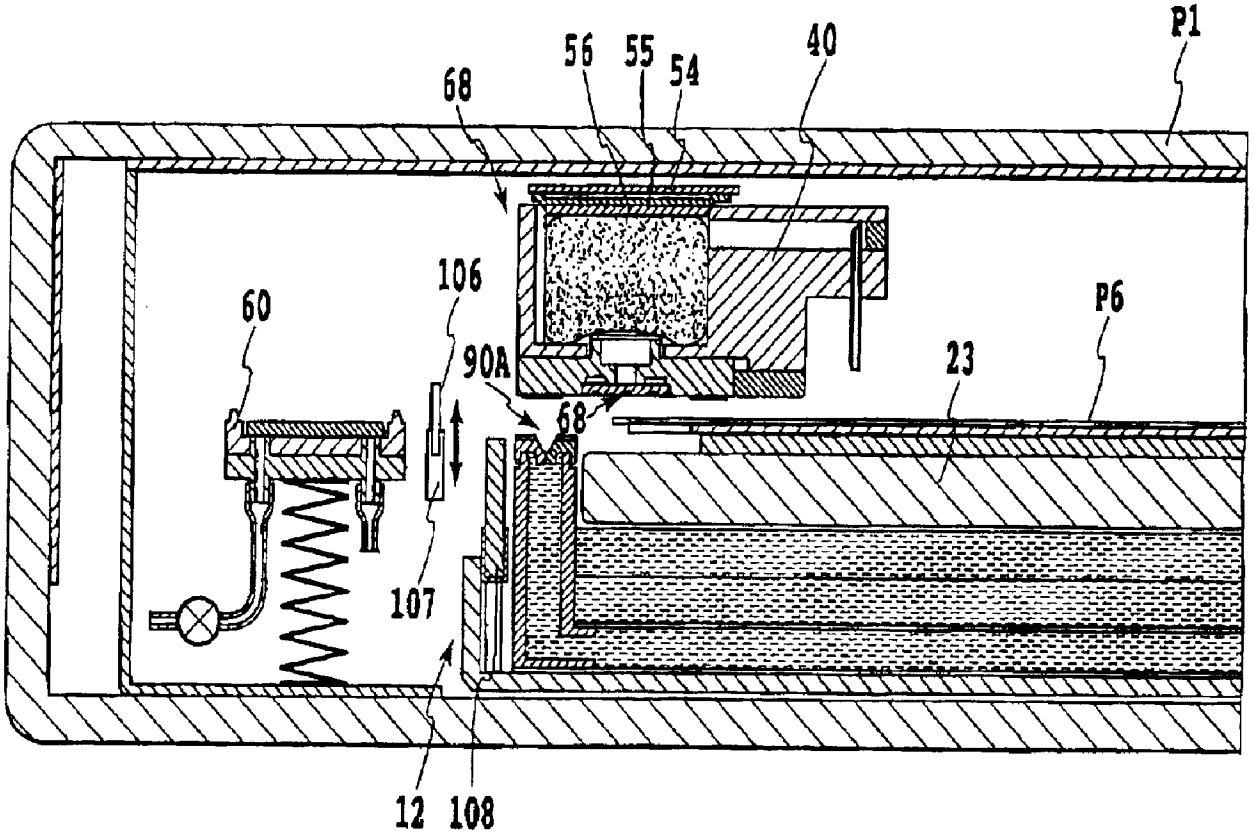
FIGS. 13 and 14 are enlarged sectional views taken along the carrier scanning direction on printing.

The carrier 40 carrying the printing head 68 (see FIG. 12) is provided with a shaft receiving member on which are formed a shaft receiving pipe 44 and a shaft receiver 43, 45 all in one as a fitting portion with the main shaft 42. The carrier 40, as shown in FIG. 12, is provided with tank sections 40*b*, 40*c*, 40*d* for storing print inks and into each of which is injected with an ink such as yellow, magenta, cyan, at an appropriate timing during printing. An interior of the tank sections 40*b*, 40*c*, 40*d* contains sponges 72, 73, 74 respectively for the use of ink impregnation. Further as shown in FIG. 13, each ink tank is bonded with a resin lid 54 and a lid member 56 is designed to allow a gas flow at a suction port 40*a* through a membrane for separating gas and liquid (hereinafter, referred to as gas-liquid separating membrane) (see FIGS. 11 and 12).

The printing head 68 has an array of ejection ports arranged in the direction different from the main scanning direction (ex. sub scanning direction). The number of array of ejection ports corresponds to the number of ink colors to be used which are arranged in parallel in main scanning direction.

Figure 11:
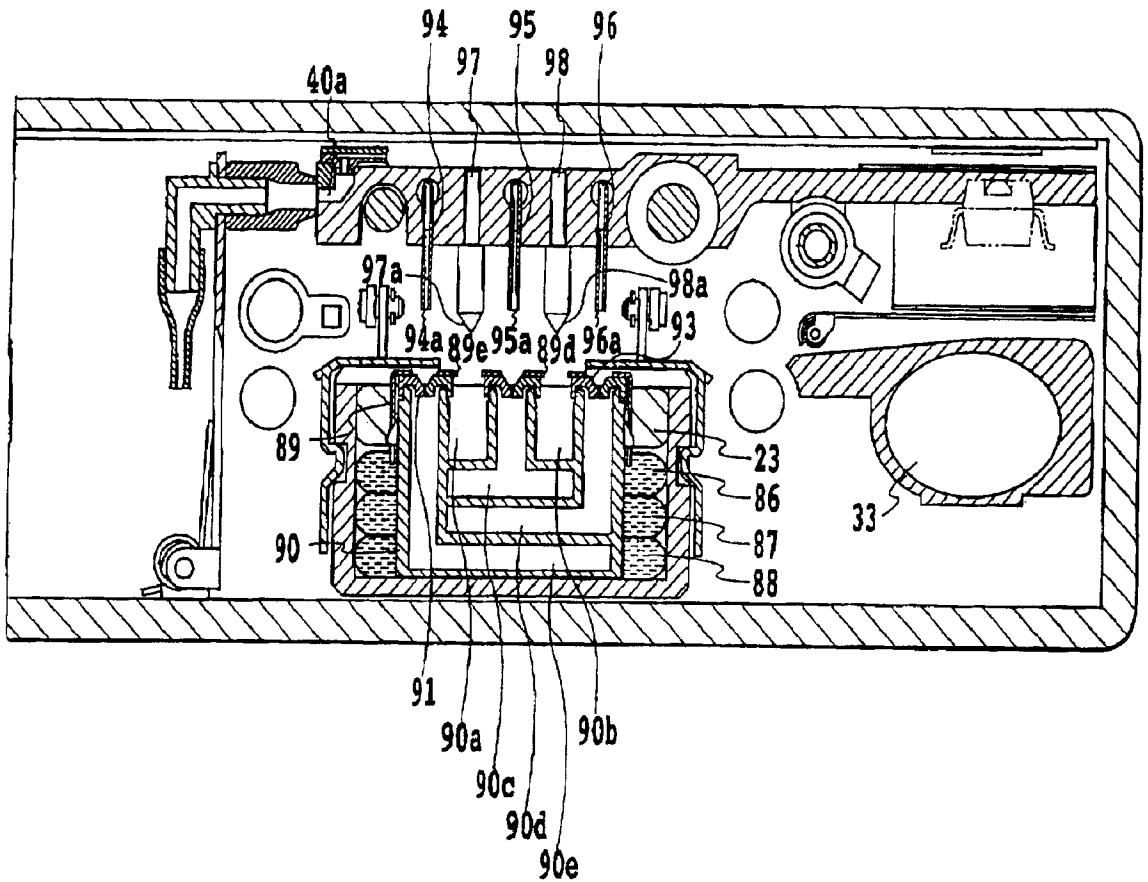
FIG. 11 is a side sectional view taken along the printing medium conveying direction and showing the print mechanism to illustrate a configuration of ink supply parts and the like in the print mechanism of the printer according to the first embodiment.

As shown in FIG. 11, the ink supplying needle 94, 95, 96 each is press fitted into the carrier 40 so as to adapt for forming an independent flow path on respective ink tanks 40*b*, 40*c*, 40*d*. Each of the positioning pins 97, 98 has a conical portion 97*a* ad 98*a* at its end. The conical portions 97*a*, 98*a* are designed to be positioned at lower position than the end of the ink supplying needle, and, as will be described later, as the platen 9 and the ink cartridge 12 are lifted up, the conical portions 97*a*, 98*a* of the end of the positioning pins 97, 98 are inserted into corresponding 89*e*, 89*d* placed on the pressure plate 89 to be positioned prior to the ink supplying needles 94, 95, 96. Hence, the ink supplying needles 94, 95, 96 each can be correctly inserted into corresponding joint rubber 91, 92, 93.

(Lift-up Mechanism)

The present embodiment employs an intermittent supply method in which the ink tanks 40*b*, 40*c* and 40*d* communicated with a printing head 68 are intermittently supplied with ink from the ink cartridge 12 as required. In the present embodiment, the intermittent supply operation is performed such that the ink cartridge 12 is lifted up to couple to the mechanisms of the printer main body as described above, and then ink is injected into the ink tanks 40*b*, 40*c*, and 40*d* on the carrier 40. A mechanism for lifting up the ink cartridge 12 will be described below.

In FIG. 4, reference numeral 57 denotes a lead screw that allows a lift slider 57 to move slidably for a lift-up operation. The lead screw 57 is rotatively driven by using a planetary gear mechanism such as that shown in FIG. 12 to switch a power transmission path for the driving force of the sheet feeding motor 1 (FIG. 3) as a driving source for feeding a sheet P6.

First, the planetary gear mechanism will be described. In FIGS. 2 and 9, a pinion gear G9 is pressed into a shaft of the sheet feeding motor 1. The power of the motor 1 is transmitted to a sun gear G12 via reduction gears G10 and G11 and further to a planetary gear G16 via a small gear G12*a* that is concentric with the sun gear G12. On the other hand, the power of the motor 1 is transmitted from the small gear G12*a* to a planetary gear G14 via a planetary gear G13. In the state shown in FIG. 12, the planetary gear G16 is separated from a transmission gear G17 and runs idly. In contrast, a planetary gear G14 coupled to the planetary gear G13 is engaged with a transmission gear G15 attached to the lead screw and can thus transmit power.

Each of the planetary gears G16, G13, and G14 is rotatably supported by a shaft provided in a rotating plate 100. The planetary gear G16 is provided with a spring to cause rotational friction between the sun gear 12 and the rotating plate 100 concentric therewith. The rotating plate 100 rotates in the same direction as the rotating direction of the sun gear G12 with a specified amount of friction. The rotating plate 100 is provided with an extended portion 100*a* so as to rotatively move between stopper pins P19 and P20 fixed to the printer main body P1. Further, the rotating plate 100 is provided with a cam surface 100*b*. When a lever 102 provided at an end of a conveying roller 78 is abutted against the stopper pin P21, the cam surface 100*b* abuts against the lever 102 to hinder the rotating plate 100 from rotating clockwise in unison with the clockwise rotation of the sun gear G12. In the state shown in FIG. 12, the lead screw 57 can be rotated forward and backward by the motor 1. Here, the lever 102 is rotatably fitted into the conveying roller 78. Further, a friction spring (not shown) is provided between the lever 102 and a gear supporting side plate P8 fixed to the printer main body P1. When the conveying roller 78 is rotated counterclockwise, the lever 102 abuts against the stopper pin P21 as shown in FIG. 12. When the conveying roller 78 is rotated clockwise, the lever 102 abuts against the stopper pin P22. Of course, the stopper pins P21 and P22 are fixed to the printer main body P1.

The lift slider 58 can move slidably in a direction parallel with the scan direction of the printing head when the lead screw 57 is rotated forward or backward as described previously. As shown in FIG. 6, the left slider 58 is provided with cam surfaces 58*a* and 58*b* that join or separate a suction joint 48 in FIG. 5 to or from the carrier 40. Further, the lift slider 58 is provided with a lift cam 58*c* to lift up the platen 9. A lift pin 9*f*, fixed to the platen 9, is engaged with the lift cam 58*c*. Moreover, the lift slider 58 is provided with a cap cam 58*d* to set or remove a suction cap 60 on or from the printing head 68*a* mounted on the carrier 40. The cap cam 58*d* is engaged with an engaging portion 59*a* of a cap holding plate 59 that holds the suction cap 60 and a cap base 62 together.

Figure 17:
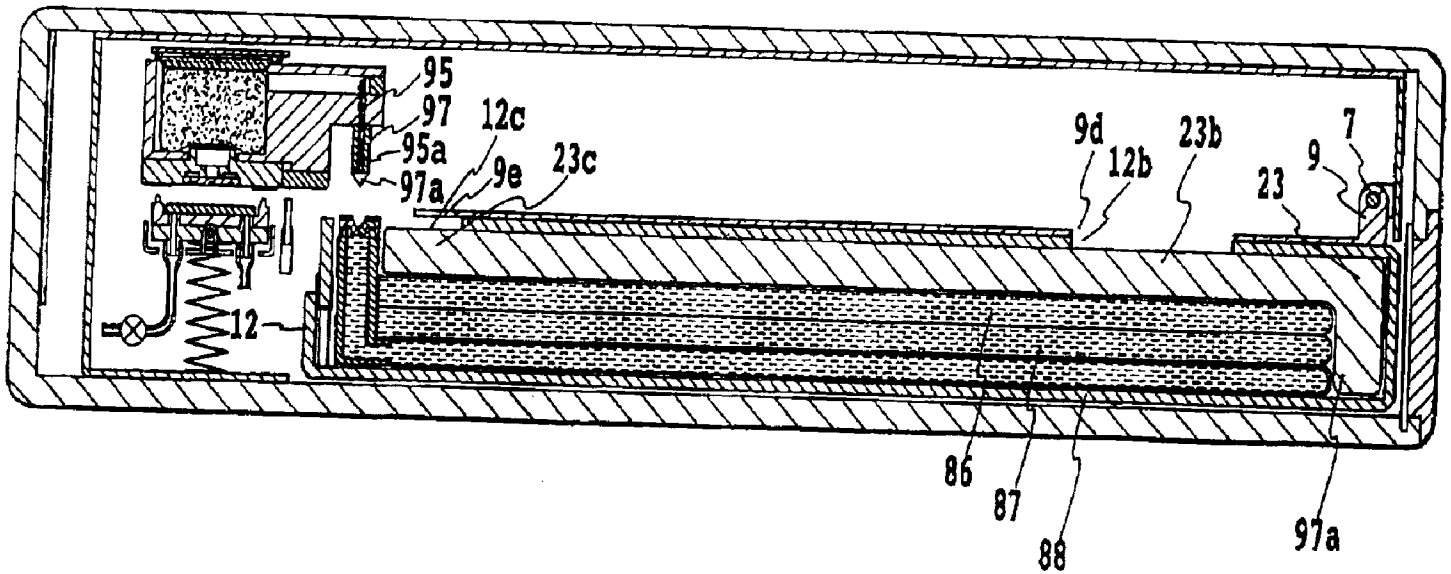
Figure 18:
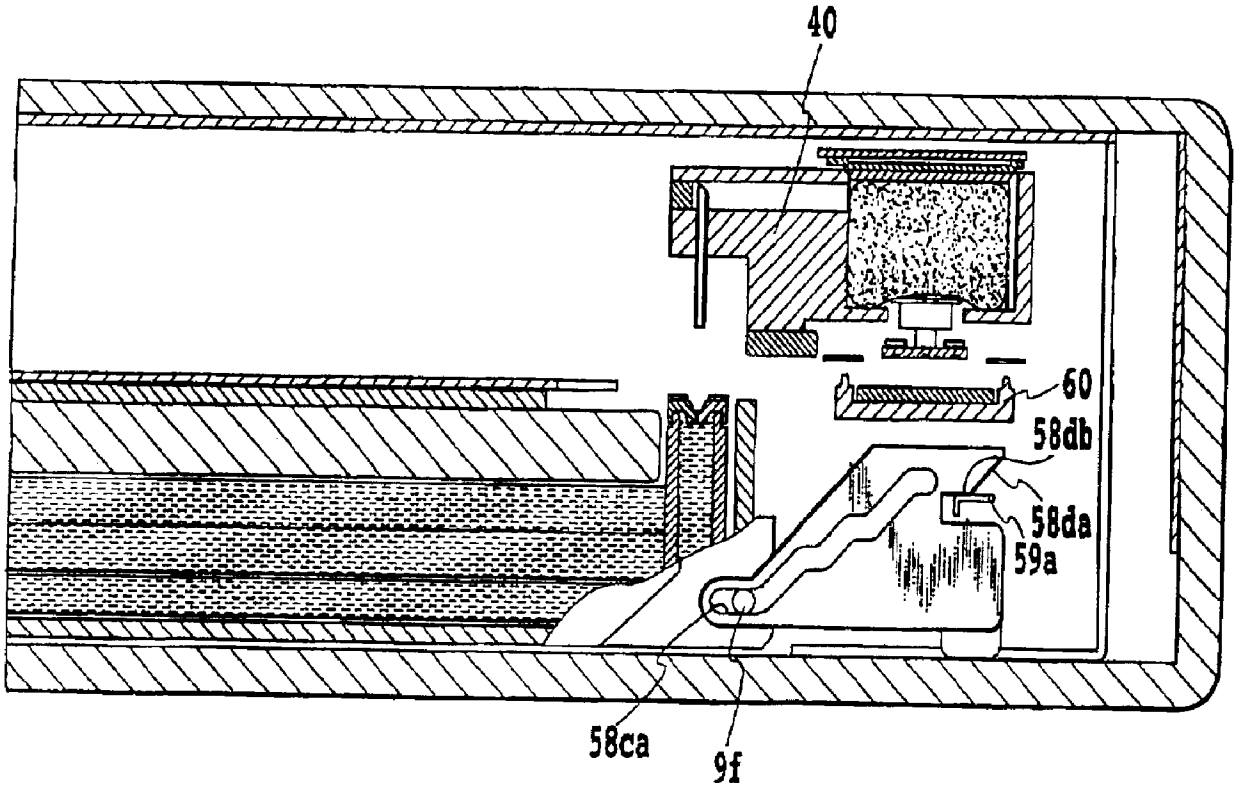
FIG. 18 is an enlarged sectional view of the printer showing a mechanism for lifting up a platen and a media pack around a rotating shaft of the platen.
Figure 19:
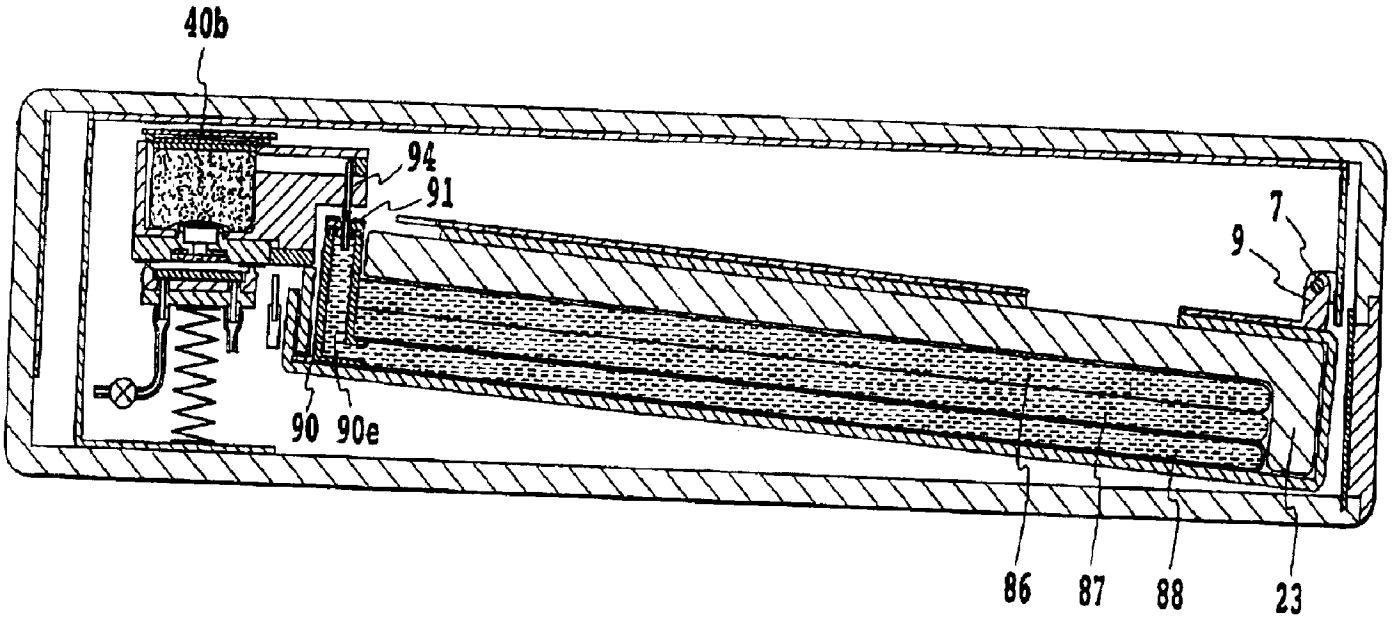
FIG. 19 is a sectional view of the printer in which the platen and the media pack has been lifted up around the rotating shaft of the platen.

As required, in a state that the carriage is moved to a position as indicated in FIG. 17, the lead screw 57 is rotated as described above, and the lift slider 58 is slided inward, thereby having the lift pin 9*f* fixed on the platen 9 move along the lift cum 58*c* to cause the platen 9 to be rotated around a rotation shaft 7 of the platen as shown in FIG. 19, thereby lifting up the ink cartridge 12. In this condition, the ink supplying needle 94 is inserted into the joint rubber 91 and therefore allows the ink in the ink bag 88 to be intermittently supplied into the ink tank 40*b* of the carrier 40 through a room 90*e* of the joint case 90.

(Wiper Mechanism)

Figure 15:
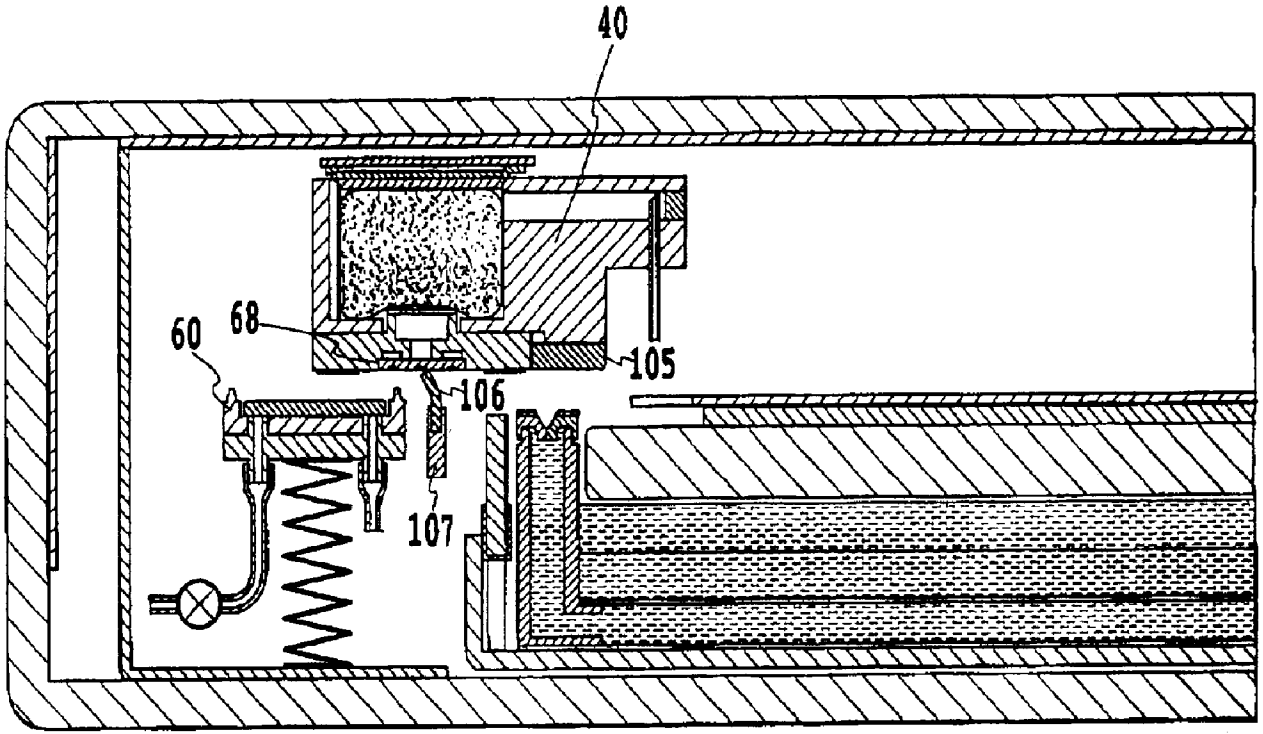
FIGS. 15 and 16 are sectional views to illustrate cleaning operations for a printing head and a wiper.
Figure 16:
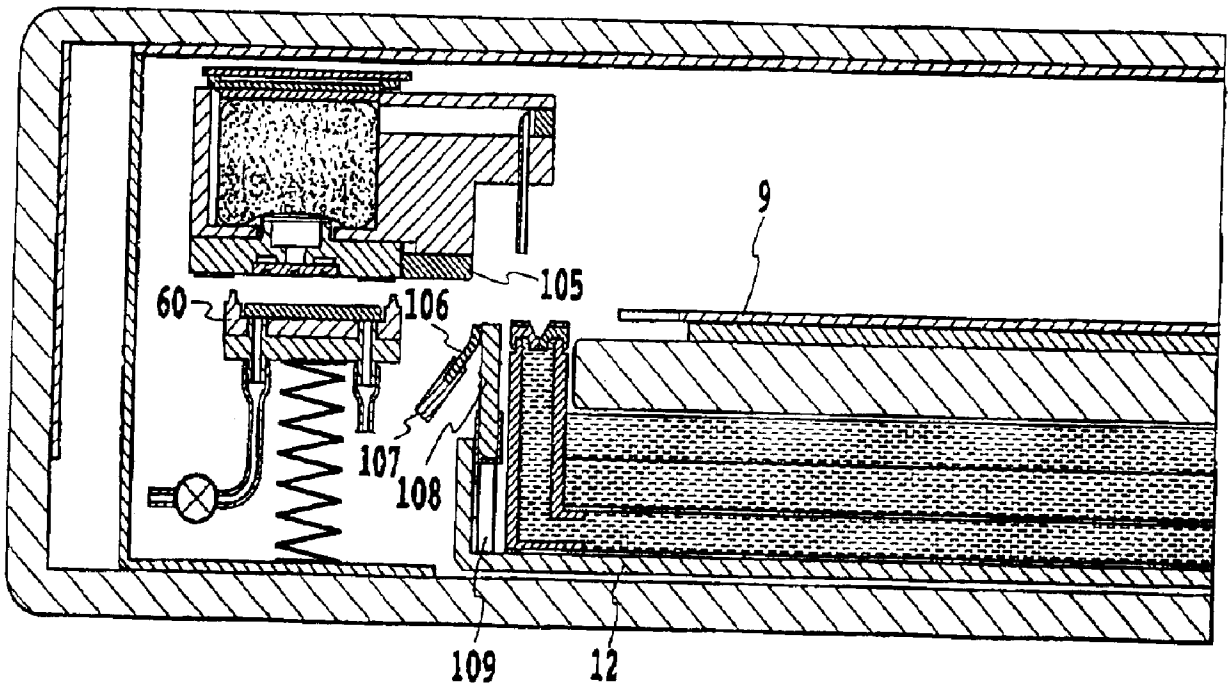

In FIG. 15, reference numeral 105 denotes an wiper ink absorber for temporarily absorbing waste ink adhered to a wiper blade 106 by which is wiped off the printing head 68. The wiper ink absorber is formed of a material such as a sponge. It is disposed on the carrier 40 so as to be substantially flush with surface of the printing head 68 on which the ejection openings are formed. The wiper blade 106 is formed of rubber or the like. It is attached to a wiper holder 107 so as to be movable in a vertical direction orthogonal to the scan direction of the carrier 40 (FIG. 13) and to be rotatable (FIG. 16). Specifically, when the wiper blade 106 is at its lifted position, it can engage with the ejection opening formed surface of the printing head to enable a wiping operation as shown in FIG. 15. When the wiper blade 106 is at its rotated position, it can engage with a wiper ink absorbing pad 108 as shown in FIG. 16 to transmit the waste ink adhering to the wiper blade 106, to the wiper ink absorbing pad 108 in the ink cartridge 12 (FIG. 16).

As shown in FIG. 16, the wiper ink absorbing pad 108 is held on the pad holder 109, formed of a plate spring, so as to be slidable in the vertical direction. When the ink cartridge 12 is lifted up, the wiper ink absorbing pad 108 is pressed against the wiper ink absorber 105, disposed on the carrier 40, owing to the spring force of the pad holder 109. Thus, waste ink in the wiper ink absorber 105 can be transmitted to the wiper ink absorbing pad 108. Of course, the wiper ink absorbing pad 108 is set to have a higher permeability than the wiper ink absorber 105.

(Printing Operation)

Figure 14:
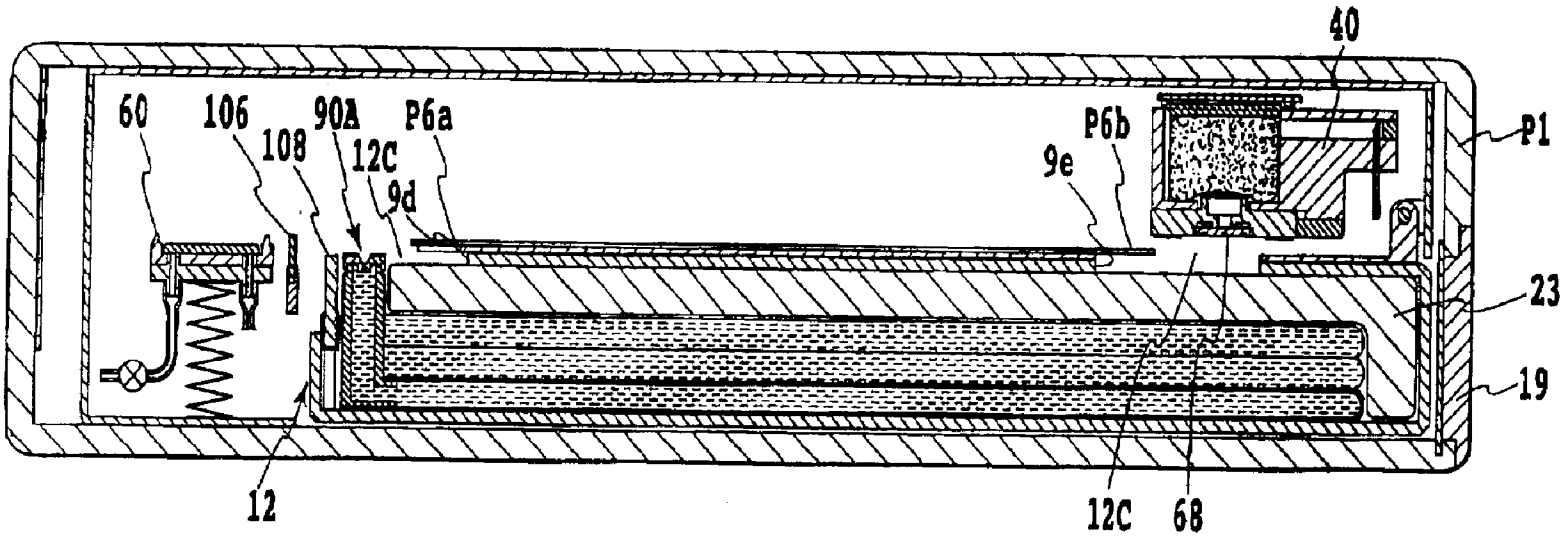

The feeding roller 80 as shown in FIG. 4 is driven to convey a printing sheet P6 so as to set on a printing position. While the carrier 40 performs a reciprocate movement between the positions as shown in FIGS. 13 and 14, an amount of ink corresponding to an image date is ejected onto the print sheet P6 from the printing head 68 to perform a printing. At that time, by ejecting the ink to the outside of both ends P6*a*, P6*b* of the print sheet P6, full bleed printing is achieved. The ink ejected outside of the print sheet P6 is collected by the waste ink absorber 23 placed facing to the openings 12*c* provided with the ink cartridge 12.

(2) Embodiment of Control System

Figure 20:
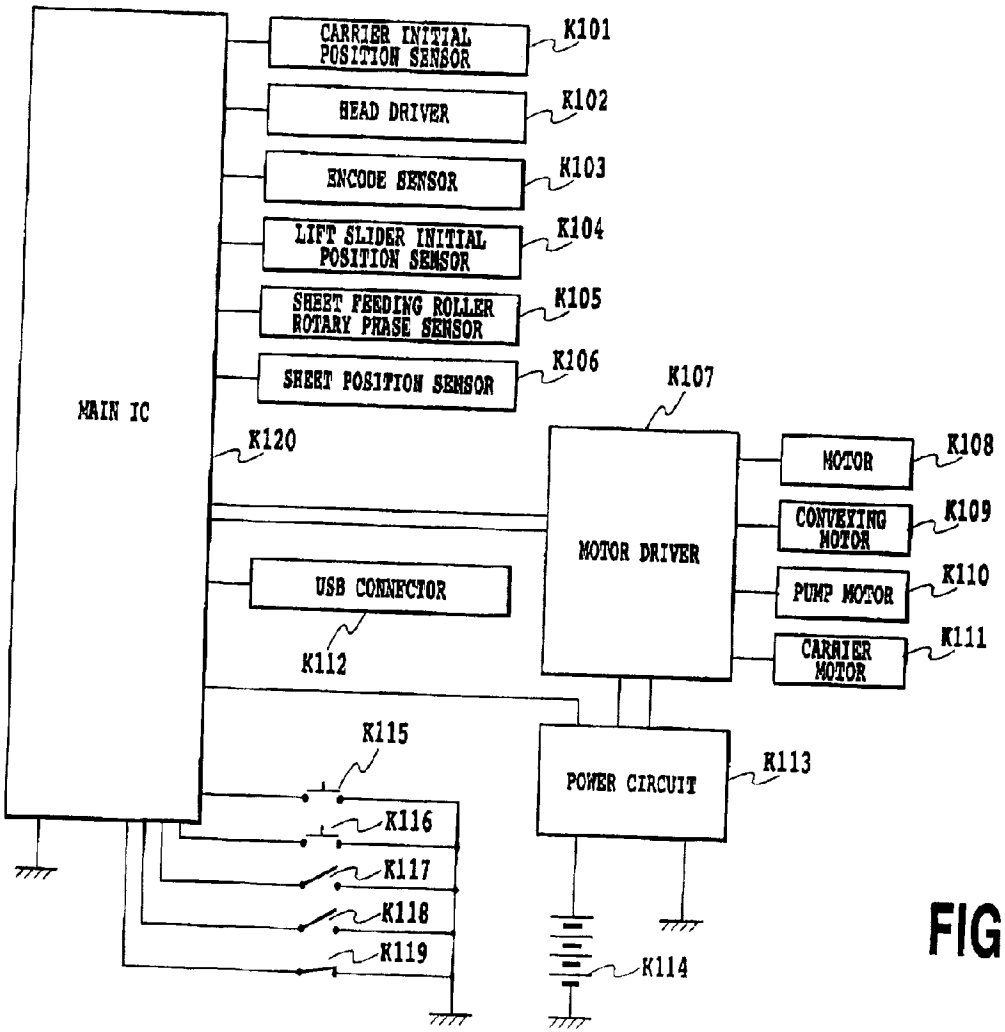

With reference to FIGS. 20 and 21, description will be given of embodiments of a control system and of the control of the whole system which embodiments are applicable to the above construction.

FIG. 20 shows an example of a configuration of this control system.

In FIG. 20, reference numeral K101 denotes a sensor for establishing the initial position of the carrier 40 for printing. Reference numeral K102 denotes a driver for controlling ink jet print elements for the respective colors in the printing head 68. Reference numeral K103 denotes an encode sensor for defining print timings (ink ejection timings) in accordance with a main scanning position used when the carrier 40 executes scanning (main scanning) for printing. The encode sensor K102 is, for example, an optical sensor that reads a bar chart extending in a main scanning direction.

Reference numeral K104 denotes a sensor that checks the initial position of the lift slider 58. The sensor K104 is used to determine where the lift slider 58 is when the planetary gear G14 and the transmission gear G15 are engaged with each other. Reference numeral K105 denotes a sensor that detects that the sheet feeding roller 80, which partly has a flat surface 80*a*, is rotating. The sensor K105 is used to set the flat surface 80*a* in the direction of a sheet in order to reduce conveying loads once sheet feeding is completed. Reference numeral K106 denotes a sensor that detects the position of a sheet fed by the conveying roller 78, on which a print operation starts to be performed.

Reference numeral K107 denotes a driver circuit for driving four driving motors provided in the apparatus, in accordance with control signals from a main IC K120. Reference numeral K108 denotes a motor that is a driving source for driving the sheet feeding roller and the lift slider. The motor K108 corresponds to the above described motor 1. Reference numeral K109 denotes a motor for driving to slide a piston of the cylinder pump 33. Reference numeral K111 denotes a motor for rotating the lead screw 35 in order to move the carrier 40 for scanning (main scanning).

Reference numeral K112 denotes a connector circuit conforming to the USB or other standards and which receives image data on printing from equipment constituting a source of image data for the printer. Specifically, for printing, print image data from a personal computer is inputted to the connector circuit K112, or photographed images from a digital camera are inputted directly to the connector circuit K112. Reference numeral K113 denotes a power circuit for controlling power supplied by a power source K114, to a predetermined voltage, the power source K114 being composed of four cells connected in series as shown in FIG. 3, and then supplying this predetermined voltage to the driver circuit K107 and the main IC K120.

Reference numeral K115 denotes a main switch for turning on and off a power source for the printer. Reference numeral K116 denotes a replacement switch operated to replace the ink cartridge 12. Reference numeral K117 denotes a presence or absence switch for the ink cartridge 12. Reference numeral K118 denotes a lid full open switch turned on when the opening and closing lid 19 is fully opened. Reference numeral K119 denotes a lid close completion switch that is operated when the opening and closing lid 19 is closed.

The main IC K120 is responsible for controlling the entire printing process while monitoring signals from the sensors. The main IC K120 is composed of a CPU for executing a process procedure described later, a ROM in which fixed data such as programs corresponding to the control procedure is stored, a RAM having a work area, a image data storing area, an image processing area, and other areas.

Figure 21B:
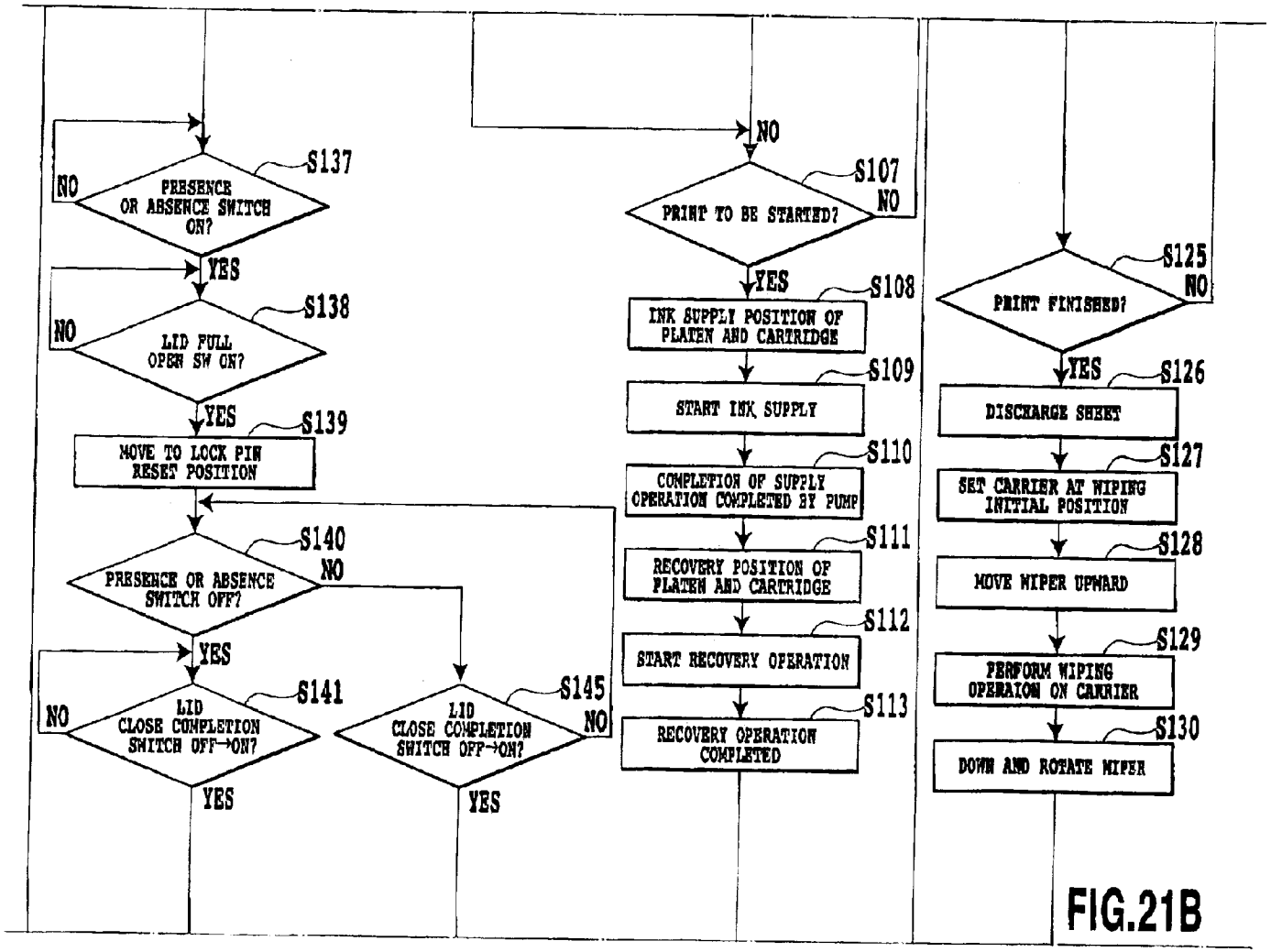
FIG. 21 is a diagram showing the relation among FIGS. 21A, 21B and 21C, FIGS. 21A, 21B and 21C being a flow chart showing an example of a control procedure executed by the control system in FIG. 20.
Figure 21C:
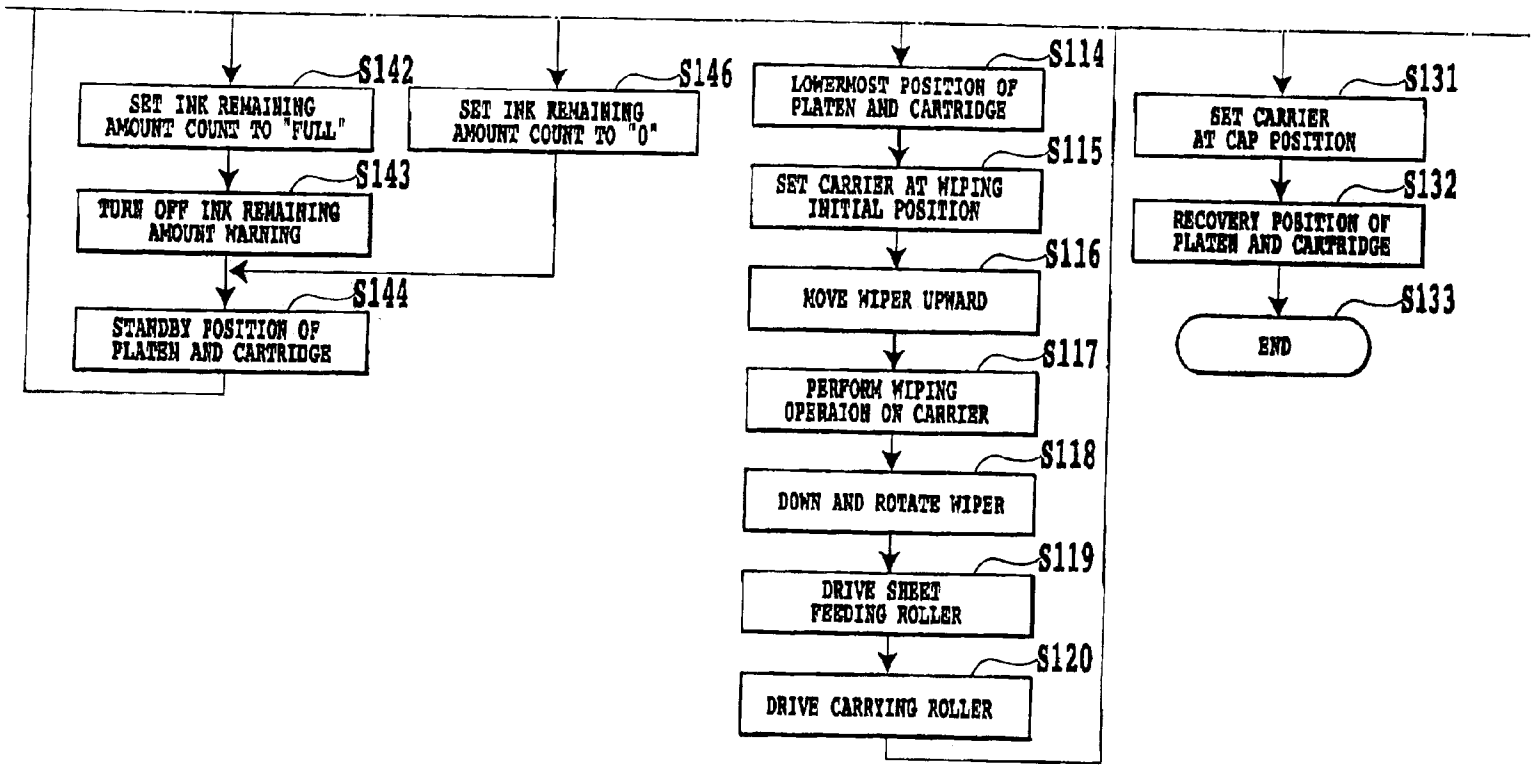

FIGS. 21A to 21C show an example of a control procedure executed by the control system in FIG. 20. This procedure will be described below in connection with operations of the apparatus according to the above embodiment. However, this procedure is also applicable to the other second and third embodiments described later.

First, a normal print sequence will be described. In this case, after the main switch has been turned on, the printer commonly receives a print start signal from an image data source connected to the printer via a USB or the like, to continue its operations. Further, image data to be printed is a sequence inputted via the USB or the like. However, well-known techniques can be used for the processing of the print start signal or the input of images via the USB or the like. Thus, description of such techniques is omitted.

First, the procedures proceeds from step S101 at which the procedure is started to step S102 to wait for the main switch K115, the power switch for the printer, to be turned on. When the main switch is turned on at step S102, it is determined at step S103 whether or not the replacement switch K116 for the ink cartridge 12 has been depressed. If it is determined that the replacement switch K116 has not been depressed, the amount of ink remaining in the ink cartridge 12 is checked at step S104.

The check on the amount of ink remaining, executed at step S104, is based on an ink remaining amount count which being set to "full" when an unused ink cartridge 12 is installed at step S142, described later. The "full" may be, for example, 100%. Then, the ink remaining amount, set at 100% when this unused ink cartridge was installed, is stored a nonvolatile memory such as an EEPROM. Every time a printing operation is performed, the amount of ink used in the printer is reduced for each color on the basis of each color data. Then, the results of the reductions may be used to update the storage contents of the EEPROM or the like in the main IC. When any of the updated and stored values becomes equal to or smaller than a predetermined determination reference value, for example, 10% with possible errors in the remaining amount taken into account, it can be determined that no ink remains in the ink cartridge. Accordingly, even if it is determined at step S104 that no ink remains, a printing operation may be performed under a certain condition. It is possible to print images that use only a small amount of ink. However, images that require a large amount of ink (particularly dark images such as night scenes) may cause the ink to be consumed up during printing, thus blurring print images.

If it is determined at step S104 that no ink remains (for example, the remaining amount is 10% or less), the procedure proceeds to step S105 to turn on an ink consumption warning. In this case, an exclusive LED or the like may be provided and lighted. However, even without such special display means, the same effect can be produced by switching, for example, a LED used as a pilot lamp for the power source from lighted state to blinking state. Then, the procedure proceeds to step S106 to determine whether or not the ink remaining amount is "0". The ink remaining amount is set to "0" at step S146 when during a replacement sequence for the ink cartridge 12, described later, the user makes an attempt to remove the ink cartridge 12 but does not actually remove it or the user removes the ink cartridge 12 but closes the opening and closing lid 19 without installing an unused ink cartridge 12.

Normally, even if print images start to be blurred after the ink consumption warning has been turned on, the ink remaining amount does not become "0" for all colors. Thus, the sequence is not affected. However, no problem occurs if the ink remaining amount is set to "−100%" after step S146 for safety. In either way, if it is determined at step S106 that the ink remaining amount is "0", the ink cartridge 12 may not have been installed. Accordingly, in this case, the procedure returns to step S103 and is inhibited from proceeding got step S107. On the other hand, if at step S106, the ink remaining amount is not "0", a little ink may remain in spite of the warning. Thus, for users who desire to execute printing even with possible blur, the procedure can proceeding to step S107 rather than inhibiting printing.

In this case or if the ink remaining amount is equal to or larger than the determination reference value and the result of the determination at step S104 is affirmative, then the procedure proceeds to step S107 to wait for a print start signal to be inputted via the connector K112. If no signals are inputted within a specified time, the procedure returns to step S103. If it is determined at step S107 that a print start signal has been inputted, a sequence of a print preparing operation, a print operation, and a print ending operation (steps S108 to S133) is executed. This sequence will be described below in brief.

If it is determined that a print start signal has been inputted, the platen and the ink cartridge are lifted up to the position (ink supply position) shown in FIG. 19 (step S108). Then, an ink supplying operation is performed (steps S109 and S110). Once this operation is finished, the platen and the ink cartridge are set at the position (recovery position) where the printing head 68 is capped by the cap 60 (step S111). Then, a recovery operation is performed (steps S112 and S113). Subsequently, the platen and the ink cartridge are set at the lowermost position shown in FIG. 17 (step S114). A wiping operation as shown in FIGS. 15 and 16 is performed (steps S116 to S118). These steps constitute a print preparing operation.

Then, in order to feed and convey the sheet 79, the sheet feeding roller 80 and the conveying roller 78 are sequentially driven (steps S119 and S120). Then, in response to sensing of the sheet (step S121), the sheet feeding roller 80 is stopped at a predetermined position (where the flat portion of the roller faces the sheet) (step S122). Then, once the leading edge of the sheet reaches the print position for the printing head 68, the conveyance is stopped (step S123). Subsequently, a print operation are performed while alternately repeating the main scanning of the carrier 4 and the conveyance of the sheet by a predetermined amount, until the sheet is completely printed (steps S124 and S125). Then, the sheet is discharged (step S126). These steps constitute a print operation.

Furthermore, as print ending operations, a wiping process (steps S127 to S130) and a capping process (steps S131 and S132) are executed. Further, the standby state, in which the printing head 68 can be stored for a long time, is established to end the sequence (step S133).

Now, description will be given of the replacement sequence for the ink cartridge 12.

If it is determined at step S103 that the replacement switch K116 for the ink cartridge 12 has been depressed, the procedure proceeds to step S134 to check the amount of ink remaining. This is because in the present embodiment, the unuse-indicating projection 12*a* is folded when the opening and closing lid 19 is opened so that the removed ink cartridge 12 can no longer be used even if it is reinstalled in the printer, whereas the ink cartridge 12 is inhibited from being removed if a sufficient amount of ink still remains. Accordingly, if it is determined at step S134 that the amount of ink remaining is, for example, 10% or more, the procedure returns to step S103 to shift to a sequence in which a printing operation can be performed. If the procedure proceeds to step S105 after it has been determined at step S134 that an amount of ink still remains, the user is unlikely to replace the ink cartridge 12 because the ink consumption warning is not turned on. Thus, typically, after the ink consumption warning has been turned on at step S105, the replacement switch is depressed at step S105. At step S134, in most cases it is determined that no ink remains. Thus, the procedure proceeds to step S135 constituting the replacement sequence for the ink cartridge 12.

The process executed at steps S135 to S139 will be described below in brief. If it is determined at step S134 that no ink remains, the platen and the ink cartridge are set at the lowermost position shown in FIG. 17 (step S135). Then, the opening and closing lid is unlocked (step S136). The procedure waits for the ink cartridge presence or absence switch and then the lid full open switch to be turned on (steps S137 and S138). Once it is confirmed that the lid full open switch has been turned on, the platen and the ink cartridge are set at the lock pin reset position (step S139).

At step S139, the lock pin 4 is reset at the position where the opening and closing lid 19 can be locked. It is thus sensed at step S140 whether or not the ink cartridge 12 with ink consumed up has been removed and an unused ink cartridge 12 has then been installed. The unuse-indicating projection 12*a* of the removed ink cartridge 12 with ink consumed up has been folded as a result of a lid opening process, and it is thus determined at step S140 that the presence or absence switch is on, which has been off in the presence of the unfolded unuse-indicating projection 12*a*. Then, the procedure proceeds to step S145. At this step, it is sensed whether or not the opening and closing lid 19 has been fully closed. If the opening and closing lid 19 has not been fully closed, a sequence is repeated in which the procedure returns to step S140.

Normally, the ink cartridge 12 with its ink consumed up is removed (since the unuse-indicating projection 12*a* has been folded as described previously, the ink cartridge 12 can be easily removed without being obstructed by the stopper member 30), and then an unused ink cartridge 12 is installed. In this case, the unuse-indicating projection 12*a* has not been folded, so that the presence or absence switch is turned off. When the unused ink cartridge 12 is completely installed, the stopper member 30 interferes with the unuse-indicating projection 12*a* to inhibit inadvertent removal. This prevents an undesirable operation of installing the unused ink cartridge 12 to allow the sequence to proceed to step S141 and then removing the used ink cartridge 12. That is, if the unused ink cartridge 12 is installed and then it is determined at step S140 that the presence or absence switch has been turned off, the procedure can proceed to step S141 without any problems.

At step S141, it is sensed whether or not the opening and closing lid 19 has been fully closed, as in the case with step S145. When the opening and closing lid 19 is closed, the lock pin 4 slides to cancel the contact between the terminal 3 and the contact 2*b* of the lock slider. When the opening and closing lid is fully closed, it is sensed that the contact is established again. Then, the procedure proceeds to step S142.

At step S142, since the unused ink cartridge 12 has been installed, the ink remaining amount is set to "full" (for example, 100%). The procedure proceeds to step S143 to turn off an ink remaining amount warning (for example, if the LED is blinking, the blinking is switched to normal lighting). The procedure then proceeds to step S144. When the ink cartridge 12 is replaced, the platen 9 and the ink cartridge 12 are located at the position as shown in FIG. 17, thus hindering the long-time storage. Thus, at step S144, the platen 9 and the ink cartridge 12 are lifted up at a predetermined position to establish the standby state. The procedure then returns to step S103.

Further, it is assumed that the inconvenient operation described below is performed. After it has been determined at step S140 that the presence or absence switch is on, the opening and closing lid 19 is closed without removing the ink cartridge 12 with ink consumed up or installing the unused ink cartridge 12 after removing the ink cartridge 12 with ink consumed up. After the determination at step S145, the procedure proceeds to step S146. Then, an ink remaining amount count is set to "0" or "−100%" to rewrite the storage contents of the EEPROM or the like in the main IC to set the state in which reprinting operations are inhibited. The procedure then proceeds to step S144 to bring the platen 9 into the standby state. The procedure then proceeds to step S103.

(3) Others

In the above embodiments, the ink cartridge 12 is slidably installed on the platen 9 in the parallel direction with as that in which the printing head is scanned during printing. However, the installing direction is not limited to this aspect. For example, the ink cartridge 12 may be installed from a direction perpendicular to the scanning direction of the printing head 68, i.e. from the bottom surface of the printer or the like. It should be appreciated that this configuration also produces effects similar to those described above.

Further, in the above example, the unuse-indicating projection 12*a* of the ink cartridge 12 is folded by moving the opening and closing lid 19 in its opening direction. However, the present invention is not limited to this aspect. For example, the position of the driving pin 25*a* of the toggle gear 25 may be shifted through 180 degrees relative to the rotating shaft P12 so that the unuse-indicating projection 12*a* can be folded by moving the opening and closing lid 19 in its closing direction. It should be appreciated that this configuration also produces effects similar to those described above.

Furthermore, in the above example, installation history is stored so as to permit the ink cartridge 12 to be installed only once depending on whether or not the unuse-indicating projection 12*a* of the ink cartridge 12 has been folded. Such an irreversible mechanism is not limited to the folding but may be arbitrarily configured. Further, the present invention is not limited to such a mechanical configuration. For example, a fuse that can be blown at a very low voltage may be set in the ink cartridge 12 so that when no installation history has been stored, this fuse is energized and can also be used to sense whether or not an unused ink cartridge is present. On the other hand, when the ink cartridge 12 is removed, a specified voltage or higher is applied to this fuse to blow it for installation history. That is, the presence of installation history maybe sensed on the basis of electrical conduction or non-conduction. It should be appreciated that this configuration also produces effects similar to those described above.

As described above, the above embodiments provide an small-sized inexpensive ink cartridge or an ink cartridge contributing to a reduction in the size of an ink jet printer that uses this ink cartridge.

According to the present invention, the first and second ink receiving members or absorbers are arranged at appropriate positions sandwiching the supply joint portion between themselves. It is then possible to collect ink adhering to or leaking from the supply joint portion, in connection with an intermittent supplying operation.

Specifically, according to the present invention, there is provided an ink cartridge having, for example, at least one ink bag in which ink supplied to a printing head is housed, and a joint portion connected to the ink bag and coupled to a printer as required to supply ink. The ink cartridge comprises an absorber (excess ink absorber) as a first receiving member that absorbs ink ejected to the outside of a sheet during printing, and an absorber (wiper ink absorber) as a second receiving member that absorbs and removes waste ink resulting from an operation performed by a wiper to wipe off ink or the like remaining on an ejection opening formed surface of the printing head. Consequently, the printer in which the ink cartridge is installed need not have an area in which waste ink is stored. The space efficiency of the printer can be significantly improved to enable the size of the printer to be sharply reduced.

In this case, the excess ink absorber and the wiper ink absorber are exposed so as to face in the same direction as a joining direction of the joint portion. Then, the printer can be configured so that the ink cartridge is installed immediately below the printing head. Further, the joint portion of ink cartridge can be connected directly to the printing head for ink supply. This significantly improves the efficiency of ink supply. Moreover, the ink cartridge can directly receive ink ejected from the printing head to the outside of a sheet during printing. This eliminates the need for a forced drain mechanism for waste ink which is employed in conventional ink jet printers. Therefore, the printer configuration can not only be simplified and miniaturized but costs can also be reduced. Furthermore, the possibility of failures can be sharply reduced.

Further, the wiper ink absorber, the joint portion, and the excess ink absorber are sequentially disposed on the ink cartridge from its end surface. Thus the absorber can directly receive ink ejected to the outside of a sheet during printing. This eliminates the need for a forced drain mechanism for waste ink which is employed in conventional ink jet printers. Therefore, the printer configuration can not only be simplified and miniaturized but costs can also be reduced. Furthermore, the possibility of failures can be sharply reduced.

Moreover, a joint portion for waste ink caused by a recovery operation is provided in a direction orthogonal to the direction of an opening in the supply joint portion. This eliminates the need to install and remove a forced drain joint for a recovery operation every time an operation (in the embodiment, a lift-up operation) is performed to supply ink to the printing head. Consequently, the forced drain joint can be kept installed while the ink cartridge is installed. Therefore, it is unnecessary to take into account the leakage of waste ink from a drain pipe caused by a change in temperature, or the like.

Further, the ink supply joint portion is provided with a pair of holes used for positioning during a joining operation. Ink supply coupling members of the printer (in the embodiment, ink supply needles set in the printing head) can be reproducibly aligned with ink supply coupling members of the ink cartridge (in the embodiment, joint rubber in the ink cartridge). This prevents inconvenient ink leakage resulting from the deformation of the coupling members (joint rubber and others) caused by the misalignment of the joint during every ink supply operation. In this case, if at least three ink supplying joints (for example, three ink supplying joints corresponding to yellow, magenta, and cyan) are provided which correspond to the type of ink used, such as its color or density, the positioning holes are each arranged between the joint portions to form a pair of joints. This enables the spacing between the joint portions to be widened and prevents the mixture of colors in the joint portion. The positioning accuracy is also improved to significantly enhance the durability of the ink supply coupling members of the printer and ink cartridge.

Further, the wiper ink absorber is elastically held so as to advance and retreat in the joining direction. Consequently, not only while the ink cartridge is joined to the printing head but also at a standby or recovery position where the ink cartridge is lifted up by a different amount, the wiper ink absorber can be connected to a wiper ink holding member of the printing head. Therefore, waste ink can be more reliably absorbed.

Furthermore, the excess ink absorber and the ink bag are sequentially arranged from an opening located in the same direction as the joining direction so that the absorber is located above the ink bag so as to be superimposed on it. Consequently, the largest area can be provided for each component. This makes it possible to house the absorber as a thin sheet. Therefore, the ink cartridge can be more easily manufactured, reducing its costs. Further, waste ink can be more easily spread all over the surface of the absorber. It is thus possible to more effectively prevent ink leakage.

Further, concave installation guide grooves are formed in a pair of casing surfaces orthogonal to the joining direction of the joint portion. Consequently, a sufficiently long holding portion is provided which can be used in lifting up the ink cartridge. This eliminates the need to unnecessarily reinforce a casing of the ink cartridge. It is also possible to reduce the area of an opening and closing lid of the printer through which the ink cartridge is installed. This significantly increases the degree of freedom in the design of the printer.

The present invention has been described in detail with respect to preferred embodiments, and it will now be apparent from the foregoing to those skilled in the art that changes and modifications maybe made without departing from the invention in its broader aspect, and it is the intention, therefore, in the apparent claims to cover all such changes and modifications as fall within the true spirit of the invention.

What is claimed is:

1. A cartridge that can be installed in an ink jet printer for performing printing on a printing medium by using a printing head for ejecting ink, said cartridge comprising a supply joint portion connected to said printing head as required and an ink housing portion in which ink to be supplied is accommodated, said cartridge comprising:

a first receiving member that receives ink ejected by said printing head to an outside of the printing medium; and a second receiving member that contacts with a wiper provided in said ink jet printer that wipes off ink remaining on an ejection opening formed surface of said printing head to receive ink resulting from the wiping operation performed by said wiper, and wherein said first and second receiving members are arranged so as to sandwich said supply joint portion between themselves.

2. A cartridge as claimed in claim 1, wherein said first and second receiving members are arranged in proximity to or in contact with said supply joint portion.

3. A cartridge as claimed in claim 1, wherein said second receiving member, said joint portion, and said first receiving member are sequentially disposed from one end surface.

4. A cartridge as claimed in claim 1, wherein said first receiving member and second receiving member are exposed at an exposed face so as to face in the same direction as a joining direction of said ink supply joint portion for supplying said ink.

5. A cartridge as claimed in claim 4, wherein said first receiving member and said ink housing portion are sequentially arranged from the exposed face such that said first receiving member is located above said ink housing portion so as to be superimposed on said ink housing portion.

6. A cartridge as claimed in claim 1, wherein said first and second receiving members are formed by using absorber.

7. A cartridge as claimed in claim 1, wherein each of said first and second receiving members are constructed by a capillary path and an absorber placed on an end thereof.

* * * * *